US009075379B2

(12) United States Patent
Egawa

(10) Patent No.: US 9,075,379 B2
(45) Date of Patent: Jul. 7, 2015

(54) DECURLER DEVICE AND IMAGE FORMING APPARATUS INCLUDING THE SAME

(71) Applicant: KYOCERA DOCUMENT SOLUTIONS INC., Osaka (JP)

(72) Inventor: Keisuke Egawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/086,609

(22) Filed: Nov. 21, 2013

(65) Prior Publication Data

US 2014/0140746 A1 May 22, 2014

(30) Foreign Application Priority Data

Nov. 22, 2012 (JP) ..... 2012-256079

(51) Int. Cl.

| | |
|---|---|
| ***G03G 15/00*** | (2006.01) |
| ***G03G 21/00*** | (2006.01) |
| ***B65H 23/34*** | (2006.01) |
| ***B41J 11/00*** | (2006.01) |

(52) U.S. Cl.

CPC .. *G03G 15/6576* (2013.01); *G03G 2215/00662* (2013.01); *B41J 11/0005* (2013.01); *B65H 2301/51256* (2013.01)

(58) Field of Classification Search

CPC ..... G03G 15/6576; G03G 2215/00662; G03G 2215/00704; B41J 11/0005; B65H 29/70; B65H 2301/5121; B65H 2301/51256; B65H 23/34

See application file for complete search history.

(56) References Cited

U.S. PATENT DOCUMENTS

| | | | | |
|---|---|---|---|---|
| 7,954,939 | B2 * | 6/2011 | Yamamoto et al. | 347/104 |
| 8,588,674 | B2 * | 11/2013 | Nanayama | 399/406 |
| 8,862,047 | B2 * | 10/2014 | Furushige et al. | 399/406 |

FOREIGN PATENT DOCUMENTS

| | | | |
|---|---|---|---|
| JP | 2006-036489 A | | 2/2006 |
| JP | 2009214975 A | * | 9/2009 |
| JP | 2011032043 A | * | 2/2011 |
| JP | 2011-219270 A | | 11/2011 |

* cited by examiner

*Primary Examiner* — Daniel J Colilla
*Assistant Examiner* — Justin Olamit
(74) *Attorney, Agent, or Firm* — Studebaker & Brackett PC

(57) ABSTRACT

A decurler device corrects a curl of a sheet. The decurler device includes a first roller, a second roller and a support unit. The first roller rotates about a first rotational shaft as an axial center. Further, the first roller is elastically deformable. The second roller rotates about a second rotational shaft in parallel with the first rotational shaft as an axial center. Further, the second roller is pressed by the first roller to elastically deform the first roller, thereby forming a curved nip portion between itself and the first roller. The second roller rotates to convey a sheet. The support unit rotatably supports the first and second rollers. Further, the support unit is rotatable about a third rotational shaft in parallel with the first rotational shaft as an axial center. The support unit rotates when a sheet is conveyed with it nipped by the nip portion.

13 Claims, 15 Drawing Sheets

DECURLER DEVICE AND IMAGE FORMING APPARATUS INCLUDING THE SAME

INCORPORATION BY REFERENCE

The present application claims priority under 35 U.S.C. §119 to Japanese Patent Applications No. 2012-256079, filed Nov. 22, 2012. The contents of this application are incorporated herein by reference in their entirety.

BACKGROUND

The present disclosure relates to decurler devices for correcting (decurling) a curl of a sheet and image forming apparatuses including the same.

Image forming apparatuses including a decurler device are known. The decurler device corrects (decurls) a curl of a sheet. The decurler device is arranged downstream of a fusing section in a sheet conveyance direction in an image forming apparatus. In an image forming apparatus, the sheet is allowed to pass through the fusing section in order to fuse a toner image transferred to the sheet. The sheet, which is heated and pressed in the fusing section, may tend to curl. In the image forming apparatus, the sheet is ejected to an exit port. When the sheet curls, the accommodation capacity of the exit port for sheets may reduce.

Curls of a sheet are roughly divided into an upward curl and a downward curl. The upward curl means upward curling of a lead edge of the sheet, and the downward curl means downward curling of a lead edge of the sheet. In order to address both the upward curl and the downward curl, a technique which vertically turns over the decurler device is known. Further, a technique to make nip pressure between rollers variable is known. According to this technique, the effect of curl correction (decurling) is adjustable.

SUMMARY

A decurler device according to an aspect of the present disclosure includes: a first roller, a second roller, a support unit, a unit drive section, a roller drive section, and a drive controller. The first roller includes a first rotational shaft and rotates about the first rotational shaft as an axial center. Further, the first roller is elastically deformable. The second roller includes a second rotational shaft in parallel with the first rotational shaft and rotates about the second rotational shaft as an axial center. Further, the second roller elastically deforms the first roller by being pressed by the first roller to form a curved nip portion between itself and the first roller. The second roller rotates to convey a sheet. The support unit pivotally supports the first and second rotational shafts to rotatably support the first and second rollers. Further, the support unit includes a third rotational shaft in parallel with the first rotational shaft and is rotatable about the third rotational shaft as a center axis. The unit drive section rotates the support unit. The roller drive section rotates the second roller. The drive controller controls the unit drive section and the roller drive section. Further, the drive controller rotates the support unit when the sheet is conveyed with it nipped by the nip.

An image forming apparatus according to another aspect of the present disclosure includes: a decurler device, a conveyance path, and an image forming section. The decurler device includes: a first roller, a second roller, a support unit, a unit drive section, a roller drive section, and a drive controller. The first roller includes a first rotational shaft and rotates about the first rotational shaft as an axial center. Further, the first roller is elastically deformable. The second roller includes a second rotational shaft in parallel with the first rotational shaft and rotates about the second rotational shaft as an axial center. Further, the second roller elastically deforms the first roller by being pressed by the first roller to form a curved nip portion between itself and the first roller. The second roller rotates to convey a sheet. The support unit pivotally supports the first and second rotational shafts to rotatably support the first and second rollers. Further, the support unit includes a third rotational shaft in parallel with the first rotational shaft and is rotatable about the third rotational shaft as a center axis. The unit drive section rotates the support unit. The roller drive section rotates the second roller. The drive controller controls the unit drive section and the roller drive section. Further, the drive controller rotates the support unit when the sheet is conveyed with it nipped by the nip portion. The conveyance path includes the nip portion in the decurler device. In the conveyance path, a sheet is conveyed in a conveyance direction. The image forming section is arranged in a vicinity of the conveyance path and forms an image on a sheet.

DETAILED DESCRIPTION

Embodiments of the present disclosure will be specifically described below with reference to the accompanying drawings. It is noted that like numerals denote like elements or corresponding elements in each drawing, and the description for the elements will not be repeated.

First Embodiment

Figure 1:
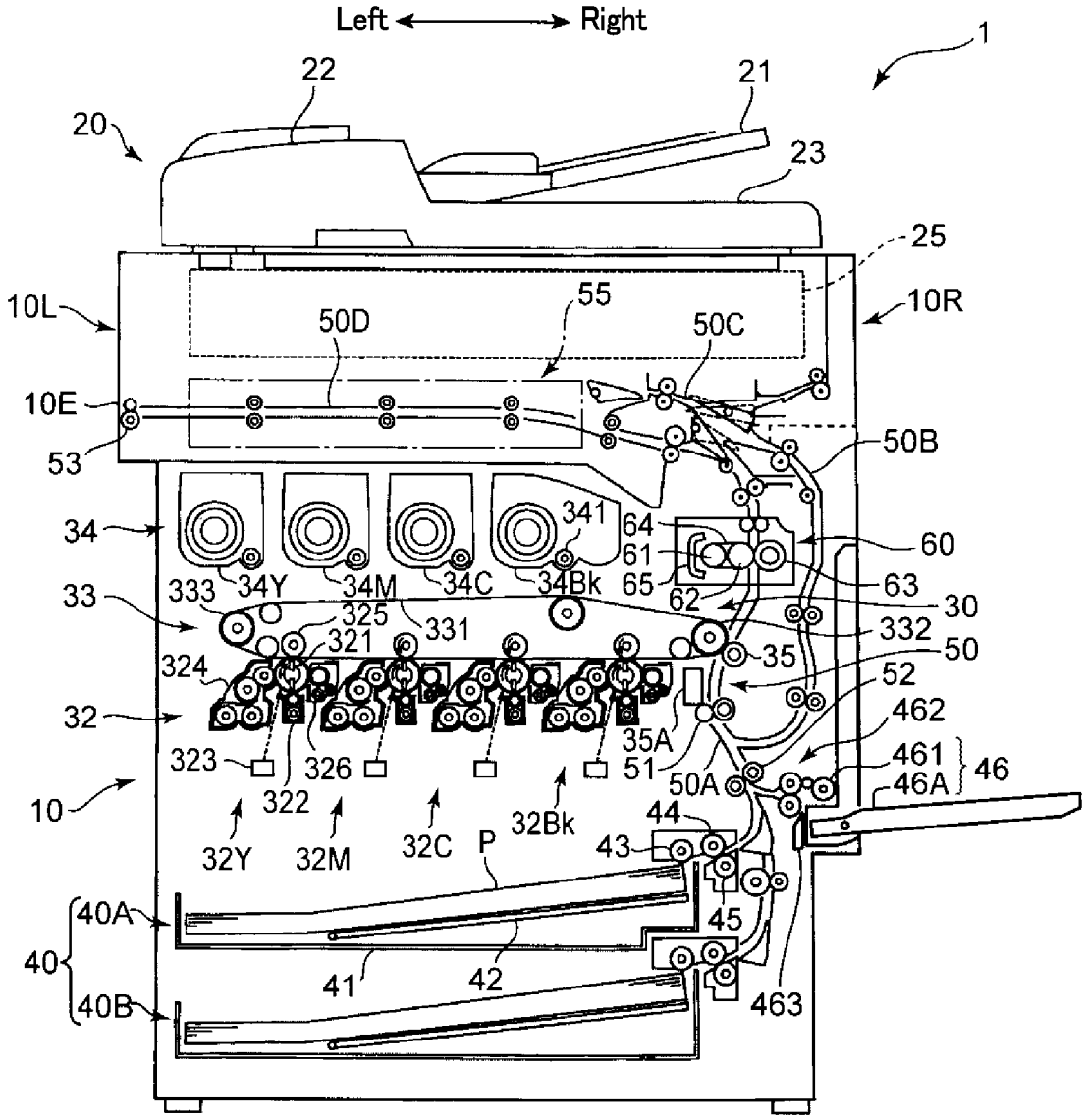
FIG. 1 is a cross sectional view showing an internal structure of an image forming apparatus according to the first and second embodiments of the present disclosure.

FIG. 1 is a cross sectional view showing an internal structure of an image forming apparatus 1 according to the first embodiment of the present disclosure. Herein, a multifunction peripheral having a printer function and a copier function will be described as an example of the image forming apparatus 1. However, the image forming apparatus may be, for example, a printer, a copier, or a facsimile machine.

Configuration of Image Forming Apparatus

The image forming apparatus 1 includes a body 10 of the image forming apparatus 1 and an auto document feeder 20. The body 10 has a substantially rectangular parallelepiped casing. The auto document feeder 20 is arranged on the body 10. A reading unit 25, an image forming section 30, a fusing section 60, a paper feeding section 40, a conveyance path 50, and a conveyance unit 55 are accommodated inside the body 10. The reading unit 25 optically reads a document image to be copied. The image forming section 30 forms a toner image on a sheet P. The fusing section 60 fuses the toner image to the sheet P. The paper feeding section 40 stores standard sized sheets P which are conveyed to the image forming section 30. The conveyance path 50 is a sheet conveyance path in which a sheet P is conveyed to a sheet exit port 10E from the paper feeding section 40 or a manual paper feeding section 46 through the image forming section 30 and the fusing section 60. The conveyance unit 55 includes a horizontal conveyance path 50D thereinside. The horizontal conveyance path 50D forms part of the conveyance path 50.

The auto document feeder (ADF) 20 is rotatably mounted on the upper surface of the body 10. The ADF 20 automatically feeds a to be copied document sheet to a predetermined auto document reading point in the body 10. By contrast, when a user manually loads a document sheet on another predetermined document reading point, the ADF 20 is opened upward. The ADF 20 includes a document tray 21, a document conveyance section 22, and a document exit tray 23. A document sheet is loaded on the document tray 21. The document conveyance section 22 conveys the document sheet through the auto document reading point. The document sheet, which has been read, is ejected from the document exit tray 23.

The reading unit 25 optically reads an image of a document sheet through a first contact glass for reading a document sheet automatically fed from the ADF 20 on the upper surface of the body 10 or through a second contact glass for reading a document sheet manually loaded. Neither the first contact glass nor second contact glass is shown.

Although not shown, a scanning mechanism and an image sensor are accommodated in the reading unit 25. The scanning mechanism includes a light source, a moving carriage, a reflective mirror, etc. The scanning mechanism irradiates light to a document sheet and guides the reflected light to the image sensor. The image sensor photoelectrically converts the reflected light into an analog electrical signal. The analog electrical signal is converted into a digital electrical signal in an A/D conversion circuit. The digital electrical signal is transmitted to the image forming section 30.

The image forming section 30 transfers a full color toner image to a sheet P. The image forming section 30 includes an image forming unit 32, an intermediate transfer unit 33, and a toner supply section 34. The image forming unit 32 includes four image forming units 32Y, 32M, 32C, and 32Bk respectively for forming toner images of yellow Y, magenta M, cyan C, and black Bk. These four image forming units 32Y, 32M, 32C, and 32Bk are arranged in tandem. The intermediate transfer unit 33 is adjacently arranged on the image forming unit 32. The toner supply section 34 is arranged above the intermediate transfer unit 33.

Each of the image forming units 32Y, 32M, 32C, and 32Bk includes a photosensitive drum 321, a charger 322, an exposure device 323, a development device 324, a primary transfer roller 325, and a cleaning device 326. The charger 322, the exposure device 323, the development device 324, the primary transfer roller 325, and the cleaning device 326 are arranged around the photosensitive drum 321.

The photosensitive drum 321 rotates. An electrostatic latent image and a toner image are formed on the peripheral surface of the rotating photosensitive drum 321. As a material for the photosensitive drum 321, amorphous silicon (a-Si)-based material may be used, for example. The charger 322 uniformly electrifies the surface of the photosensitive drum 321. The exposure device 323 includes a laser light source and an optical system. As the optical system, a mirror and/or lens, etc. may be used. The exposure device 323 irradiates light based on the image date of a document image to the peripheral surface of the photosensitive drum 321. Thus, the electrostatic latent image is formed on the peripheral surface of the photosensitive drum 321.

The development device 324 feeds toner to the peripheral surface of the photosensitive drum 321 in order to develop the electrostatic latent image formed on the peripheral surface of the photosensitive drum 321. As the development device 324, a development device for two-component developer is used. The development device 324 includes a screw feeder, a magnetic roller, and a development roller.

The primary transfer roller 325 forms a primary transfer nip portion in cooperation with the photosensitive drum 321 with an intermediate transfer belt 331 sandwiched therebetween. The intermediate transfer belt 331 is provided in the intermediate transfer unit 33. The primary transfer roller 325 primarily transfers the toner image formed on the peripheral surface of the photosensitive drum 321 to the intermediate transfer belt 331. The cleaning device 326 includes a cleaning roller, etc. and cleans the peripheral surface of the photosensitive drum 321 to which the toner image has been transferred.

The intermediate transfer unit 33 includes the intermediate transfer belt 331, a driving roller 332, and a driven roller 333. The intermediate transfer belt 331 is an endless belt which is wound between the driving roller 332 and the driven roller 333. Toner images of the plurality of photosensitive drums 321 are transferred in an overlapping manner to the same region of the outer peripheral surface of the intermediate transfer belt 331. The transfer of the toner image by the primary transfer roller 325 is referred to as primary transfer.

A secondary transfer roller 35 is arranged to face the peripheral surface of the driving roller 332. The secondary transfer roller 35 is one example of the transfer section. The driving roller 332 and the secondary transfer roller 35 form a secondary transfer nip portion. The secondary transfer nip portion transfers a full color toner image which has been formed by overlapping toner images on the intermediate transfer belt 331 to a sheet P. Secondary transfer bias potential is applied to one of the driving roller 332 and the secondary transfer roller 35, and the other roller is grounded. The secondary transfer bias has an opposite polarity from a polarity of the toner image.

The toner supply section 34 includes a toner container 34Y for yellow toner, a toner container 34M for magenta toner, a toner container 34C for cyan toner, and a toner container 34Bk for black toner. The containers 34Y, 34M, 34C, and 34Bk store color toners of each color of yellow Y, magenta M, cyan C, and black Bk, respectively. The color toners of yellow Y, magenta M, cyan C, and black Bk are respectively supplied to the development devices 324 of the image forming units 32Y, 32M, 32C, and 32Bk through supply paths (not shown) from the respective toner containers 34Y, 34M, 34C and 34Bk. Each toner container 34Y, 34M, 34C, and 34Bk includes a conveyance screw 341. The conveyance screw 341 conveys the toner in the corresponding container to a corresponding toner exit port (not shown). The conveyance screw 341 is rotated by a drive section (not shown), thereby supplying the toner into the development device 324.

The paper feeding section 40 includes two paper feeding cassettes 40A and 40B. The first paper feeding cassette 40A and the second paper feeding cassette 40B respectively accommodate standard sized sheets P. These paper feeding cassettes 40A and 40B are capable of being drawn out from the body 10 frontward of the paper of FIG. 1, for example.

The first paper feeding cassette 40A includes a sheet accommodation section 41 and a lift plate 42. The sheet accommodation section 41 accommodates a sheet sheaf of accumulated standard sized sheets P. The lift plate 42 lifts up the sheet sheaf for paper feeding. A pickup roller 43 and a roller pair of a paper feeding roller 44 and a retard roller 45 are arranged at the upper right end part of the paper feeding cassette 40A. An uppermost sheet P in the sheet sheaf in the paper feeding cassette 40A is fed out on a sheet-by-sheet basis by driving the pickup roller 43 and the paper feeding roller 44. A fed-out sheet P is conveyed to the upstream end part of the conveyance path 50. It is noted that the second paper feeding cassette 40B also has a configuration similar to that of the first paper feeding cassette 40A.

The manual paper feeding section 46 is arranged on a right surface 10R of the body 10. The manual paper feeding 46 includes a manual paper feed tray 46A for manual feeding and a paper feeding roller 461. The manual feed tray 46A is openably and closably mounted on the body 10. For manual feeding, a user opens the manual paper feed tray 46A as shown in the drawing and loads a sheet P on the manual paper feed tray 46A. The sheet P loaded on the manual paper feeding tray 46A is conveyed to a manual paper conveyance path extending from the manual paper feed tray 46A by driving the paper feeding roller 461 and a pair of conveyance rollers 462. Further, the sheet P is conveyed to the conveyance path 50 from the manual paper conveyance path.

The conveyance path 50 includes a main conveyance path 50A, a reverse conveyance path 50B, a switchback conveyance path 50C, and the horizontal conveyance path 50D. The main conveyance path 50A is a path in which a sheet P is conveyed from the paper feeding section 40 to the exit of the fusing section 60 through the image forming section 30. The reverse conveyance path 50B is used when a duplex printing is performed on a sheet P. Specifically, the sheet P of which one of the surfaces is printed is returned to the image forming section 30 through the reverse conveyance path 50B. The switchback conveyance path 50C is a path for guiding a sheet P to the upstream end part of the reverse conveyance path 50B from the downstream end part of the main conveyance path 50A. The horizontal conveyance path 50D is a path in which a sheet P is conveyed in the horizontal direction to the sheet exit port 10E from the downstream end part of the main conveyance path 50A. The sheet exit port 10E is formed in a left surface 10L of the body 10. Almost part of the horizontal conveyance path 50D is formed inside the conveyance unit 55.

A pair of registration rollers 51 is arranged upstream of the secondary transfer nip portion in the main conveyance path 50A. A sheet P is temporarily stopped by the pair of registration rollers 51 which is in a stop state. Thus, skew correction is performed on the sheet P. Then, the pair of registration rollers 51 is rotated by a drive section (not shown) with predetermined timing for image transfer. Thus, the sheet P is sent out to the secondary transfer nip portion. Other than the pair of registration rollers 51, a plurality of sheet conveyance rollers 52 for conveying a sheet P are arranged in the main conveyance path 50A A paper delivery roller 53 is arranged at the most downstream end part of the conveyance path 50. The paper delivery roller 53 feeds a sheet P to a post processing device through the sheet exit port 10E. The post processing device will be described later. The post processing device is arranged on the left surface 10L of the body 10. It is noted that an image forming apparatus not including a post processing device is provided with a sheet exit tray 10TR below the sheet exit port 10E. The sheet exit tray 10TR will be described later. See FIG. 2.

The conveyance unit 55 conveys a sheet P conveyed from the fusing section 60 to the sheet exit port 10E. In the image forming apparatus 1 of the first embodiment, the fusing section 60 is arranged on the right surface 10R side of the body 10, and the sheet exit port 10E is arranged on the left surface 10L of the body 10 opposite to the right surface 10R. The conveyance unit 55 conveys a sheet P in the horizontal direction to the left surface 10L side from the right surface 10R side.

The image forming apparatus 1 further includes a post processing device (not shown). As described above, the post processing device is arranged on the left surface 10L of the body 10. The post processing device receives a sheet P from the sheet exit port 10E and performs predetermined post processing on the sheet P. The post processing includes stapling processing, booklet binding processing, etc. For example, the post processing device receives a plurality of sheets P from the sheet exit port 10E and then performs the stapling processing on the plurality of sheets P. The above described conveyance unit 55 corresponds to a conveyance path connecting the body 10 and the post processing device.

The fusing section 60 is a fusing device employing an induction heating method. The fusing section 60 performs fusing to fuse a toner image to a sheet P. The fusing section 60 includes a heating roller 61, a fusing roller 62, a pressure roller 63, a fusing belt 64, and an induction heating unit 65. The pressure roller 63 is in press contact with the fusing roller 62 to form a fusing nip portion. The heating roller 61 and the fusing belt 64 are induction-heated by the induction heating unit 65. Heat of the heating roller 61 and heat of the fusing belt 64 are provided to the fusing nip portion. The sheet P passes the fusing nip portion, thereby fusing the toner image transferred to the sheet P to the sheet P.

Figure 2:
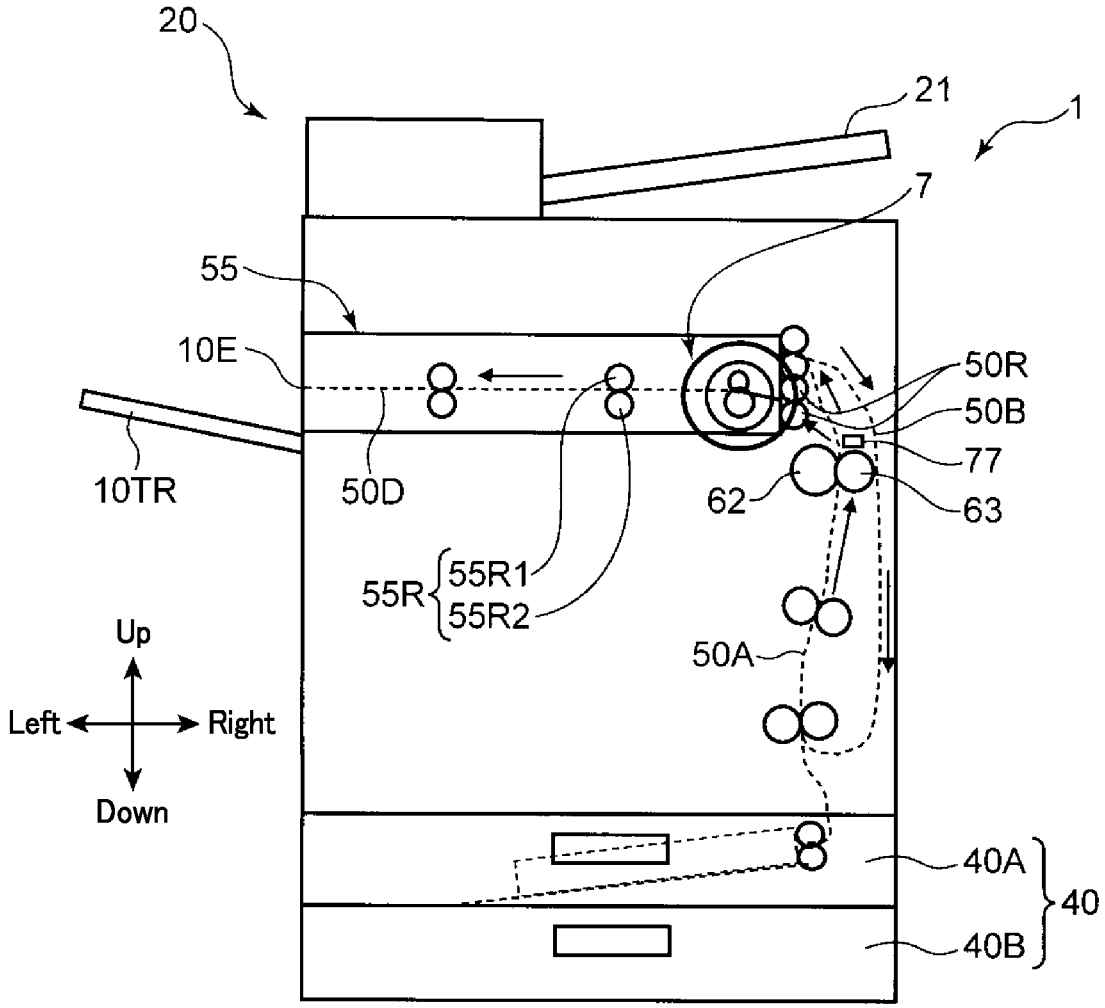
FIG. 2 is a cross sectional view of the image forming apparatus for showing an arrangement of a decurler device according to the first and second embodiments of the present disclosure.

Further, the image forming apparatus 1 includes a decurler device 7. FIG. 2 is a cross sectional view schematically showing an arrangement of the decurler device 7 in the image forming apparatus 1. The decurler device 7 corrects (decurls) a curl of a sheet P. The decurler device 7 is arranged upstream in the sheet conveyance direction in the interior of the conveyance unit 55. The sheet P subjected to fusing in the fusing section 60 is conveyed to the conveyance unit 55 by a pair of conveyance rollers 50R arranged downstream of the fusing section 60. The decurler device 7 corrects a curl of a sheet P received from the pair of the conveyance rollers 50R and then conveys the corrected sheet P to a pair of downstream rollers 55R arranged inside the conveyance unit 55. The decurler device 7 is arranged downstream of the fusing section 60. Thus, even when a sheet P is curled due to fusing in the fusing section 60, the curl of the sheet P is favorably corrected.

In the horizontal conveyance path 50D, the pair of downstream rollers 55R is arranged downstream of the decurler device 7 in the sheet conveyance direction. The pair of downstream rollers 55R is made up of a first downstream roller 55R1 and a second downstream roller 55R2. A sheet P conveyed from the decurler device 7 is conveyed toward the sheet exit port 10E with it sandwiched between the first downstream roller 55R1 and the second downstream roller 55R2. Then, the sheet P is ejected to the sheet exit tray 10TR. The pair of the downstream rollers 55 is one example of a sheet conveyance section.

When a sheet P is fused in the fusing section 60, the sheet P is heated by the fusing roller 62. Further, the sheet P is pressed toward the fusing roller 62 by the pressure roller 63. Thus, a toner image is fused to the surface of the sheet P on the side of the fusing roller 62. The shrinkage of the toner image by heat may tend to curl the sheet P. In many cases, a curl is formed such that the surface of a sheet P facing the fusing roller 62 corresponds to the inner periphery of the curl and the surface of the sheet P facing the pressure roller 63 corresponds to the outer periphery of the curl. When the sheet P curls, the accommodation capacity of the sheet exit tray 10TR for sheets P may reduce. The curl is corrected (decurled) by the decurler device 7, thereby stabilizing the accommodation capacity for sheets. Hereinafter, the surface of a sheet P on the side of the fusing roller 62 is referred to as a first surface. Also, the surface of a sheet P on the side of the pressure roller 63 is referred to as a second surface.

Configuration of Decurler Device

Figure 3:
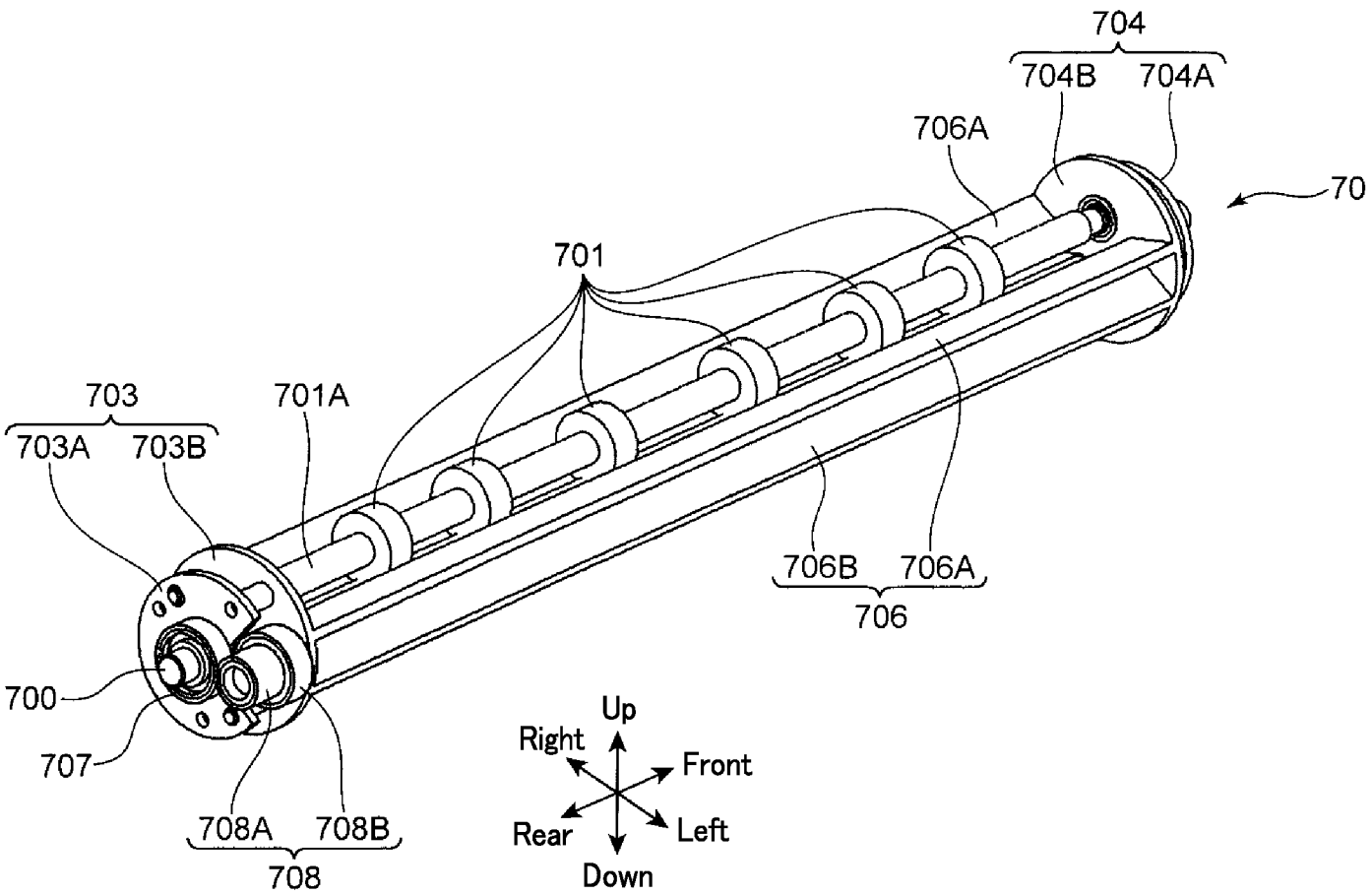
FIG. 3 is a perspective view of a correction unit according to the first embodiment of the present disclosure.
Figure 4:
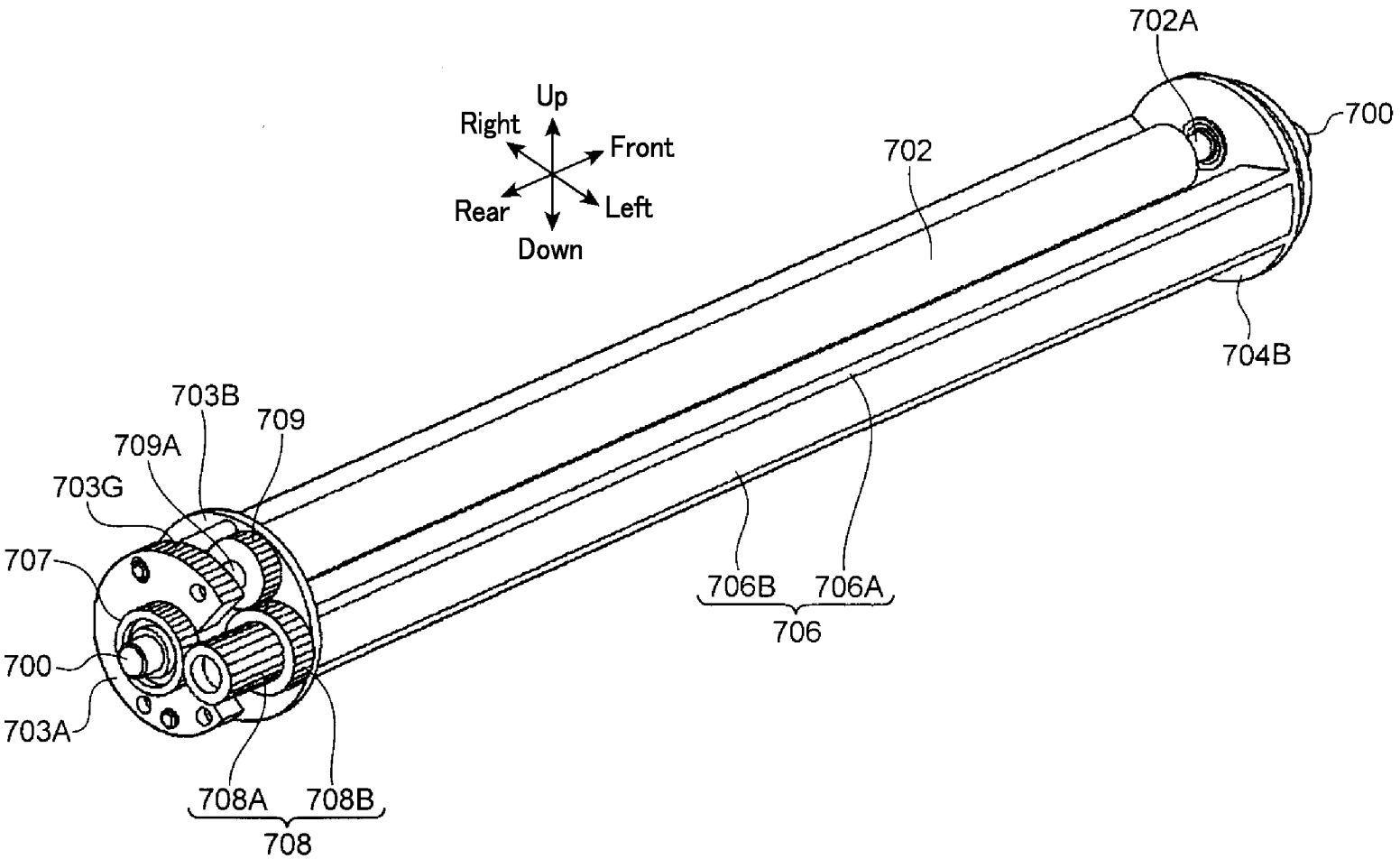
FIG. 4 is another perspective view of the correction unit according to the first embodiment of the present disclosure.
Figure 5:
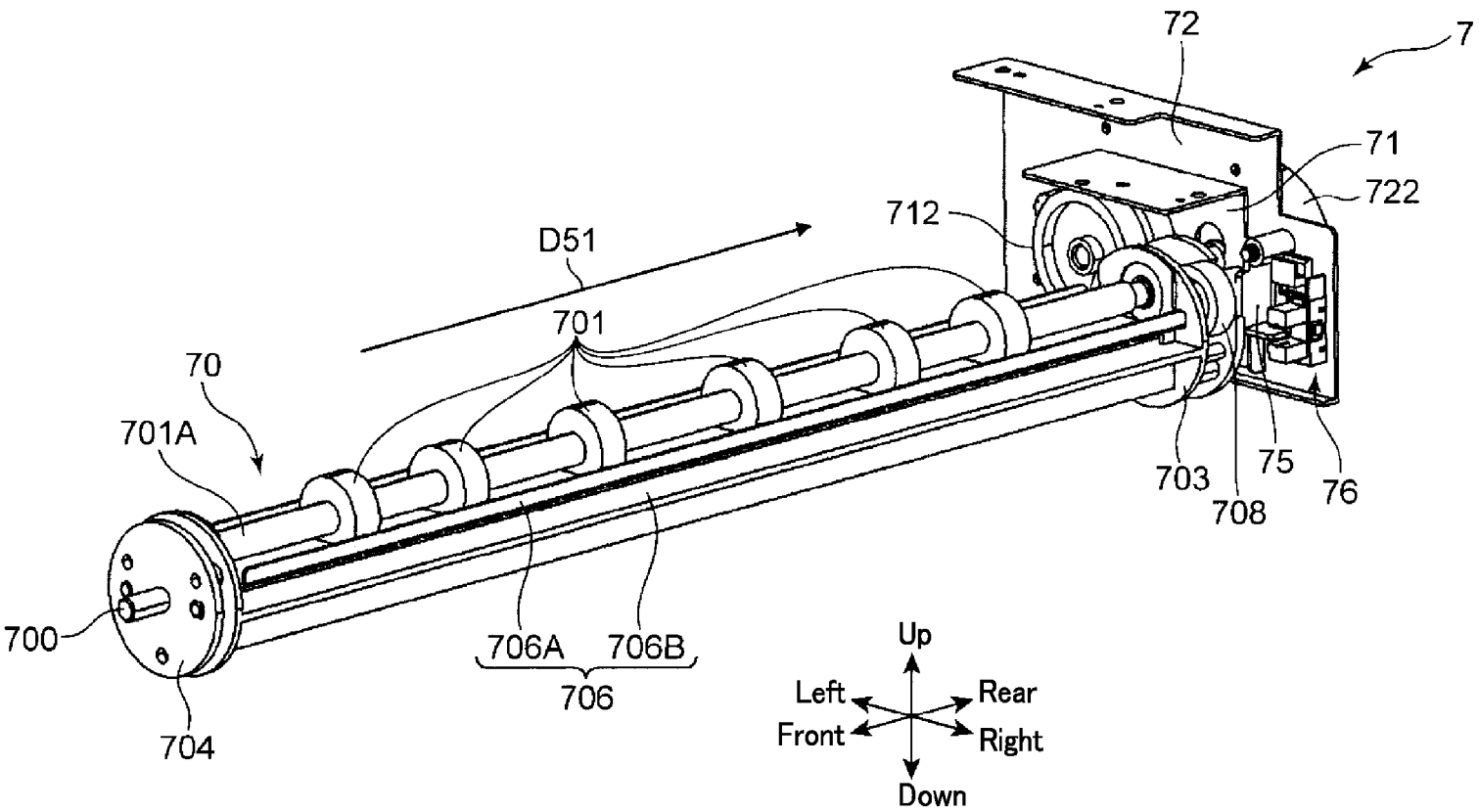
FIG. 5 is a perspective view of the decurler device according to the first embodiment of the present disclosure.
Figure 6:
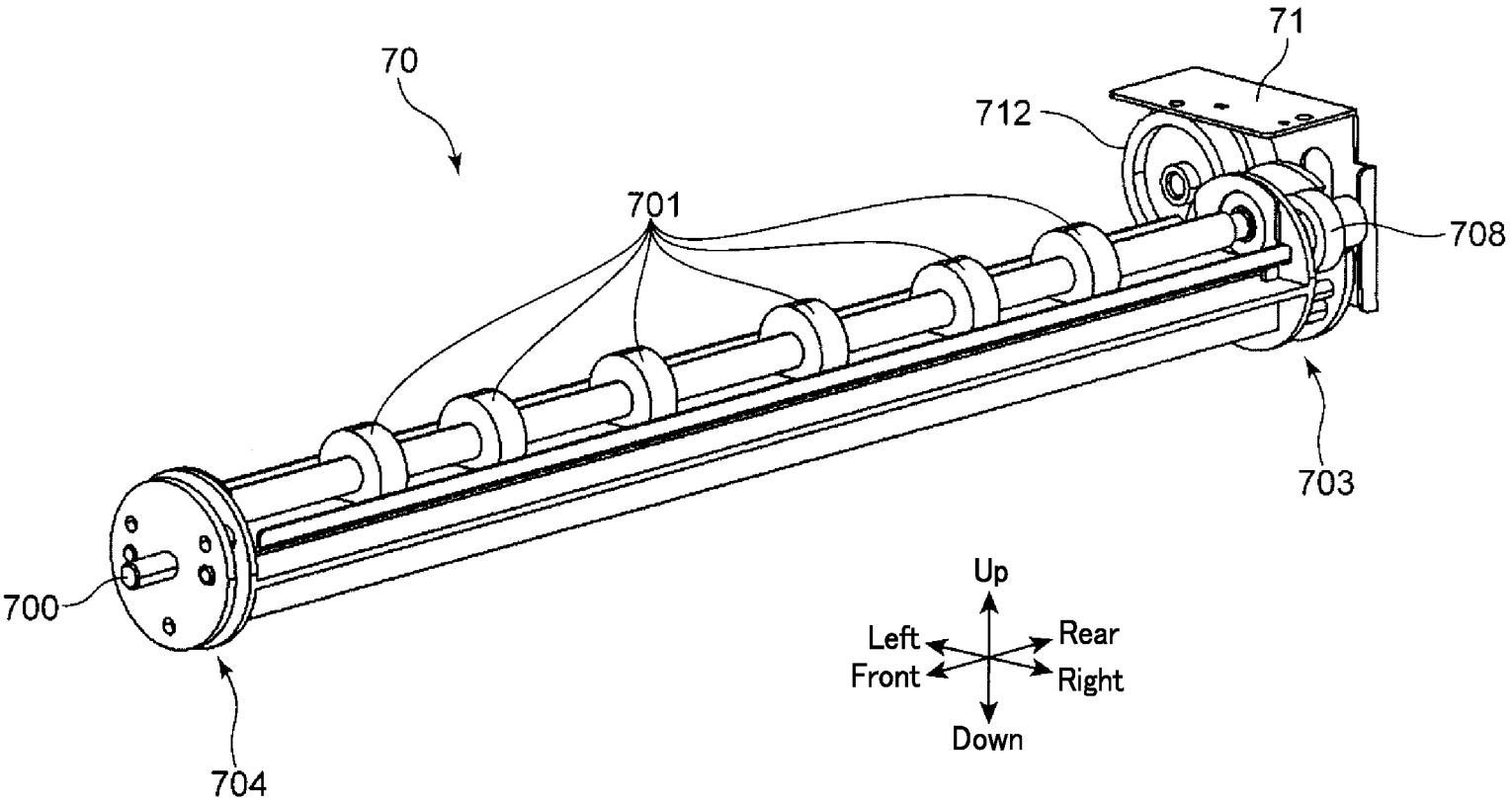
FIG. 6 is a perspective view showing a state in which the correction unit according to the first embodiment of the present disclosure is fitted to a first frame.
Figure 7:
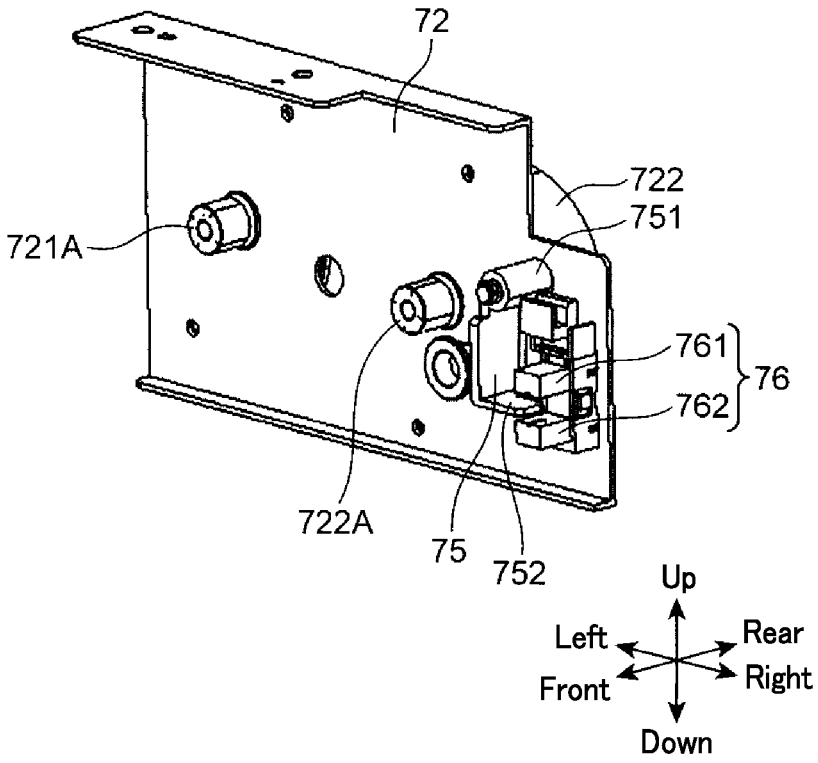
FIG. 7 is a perspective view of a second frame according to the first embodiment of the present disclosure.
Figure 8:
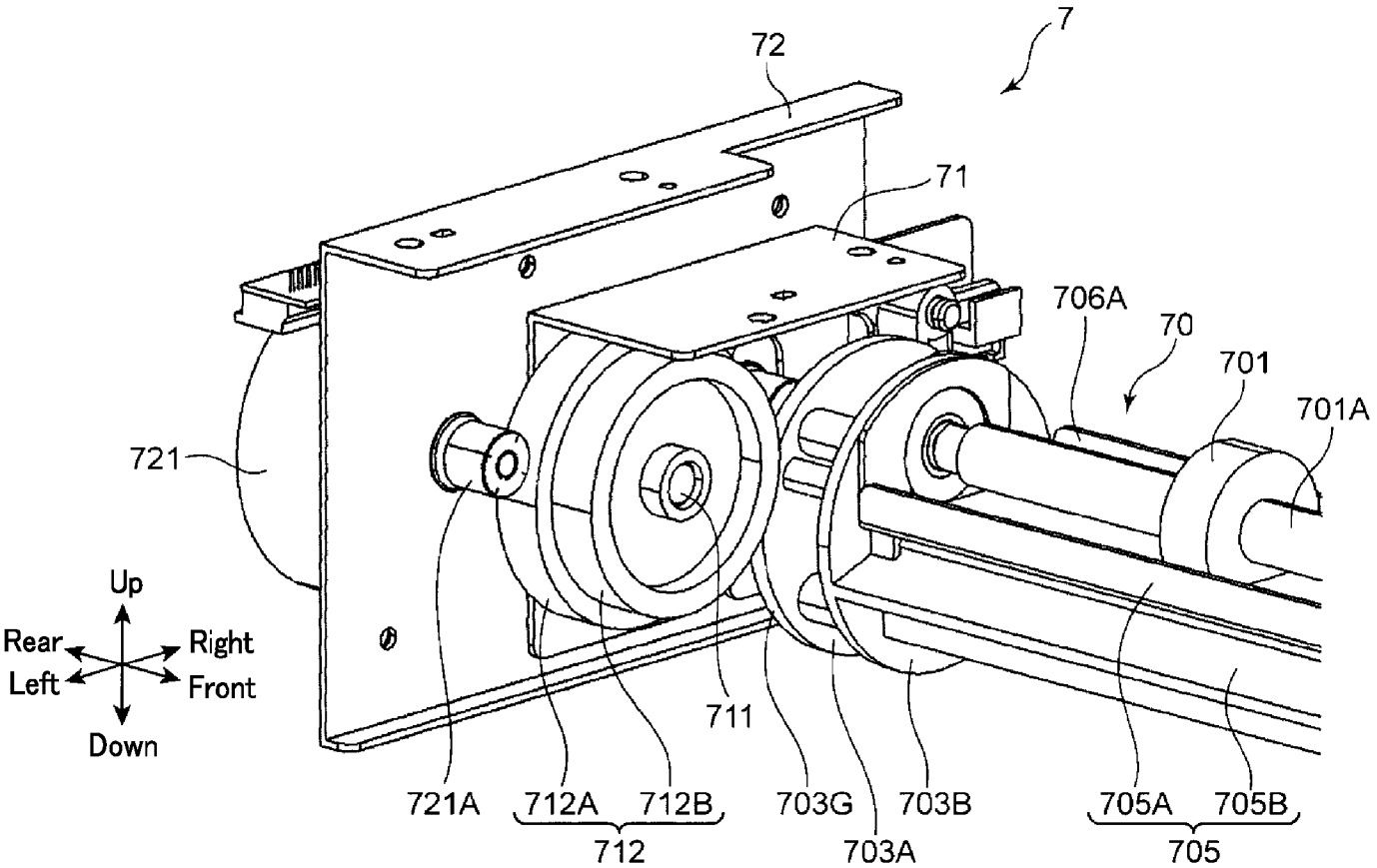
FIG. 8 is an enlarged perspective view of the decurler device according to the first embodiment of the present disclosure.
Figure 9:
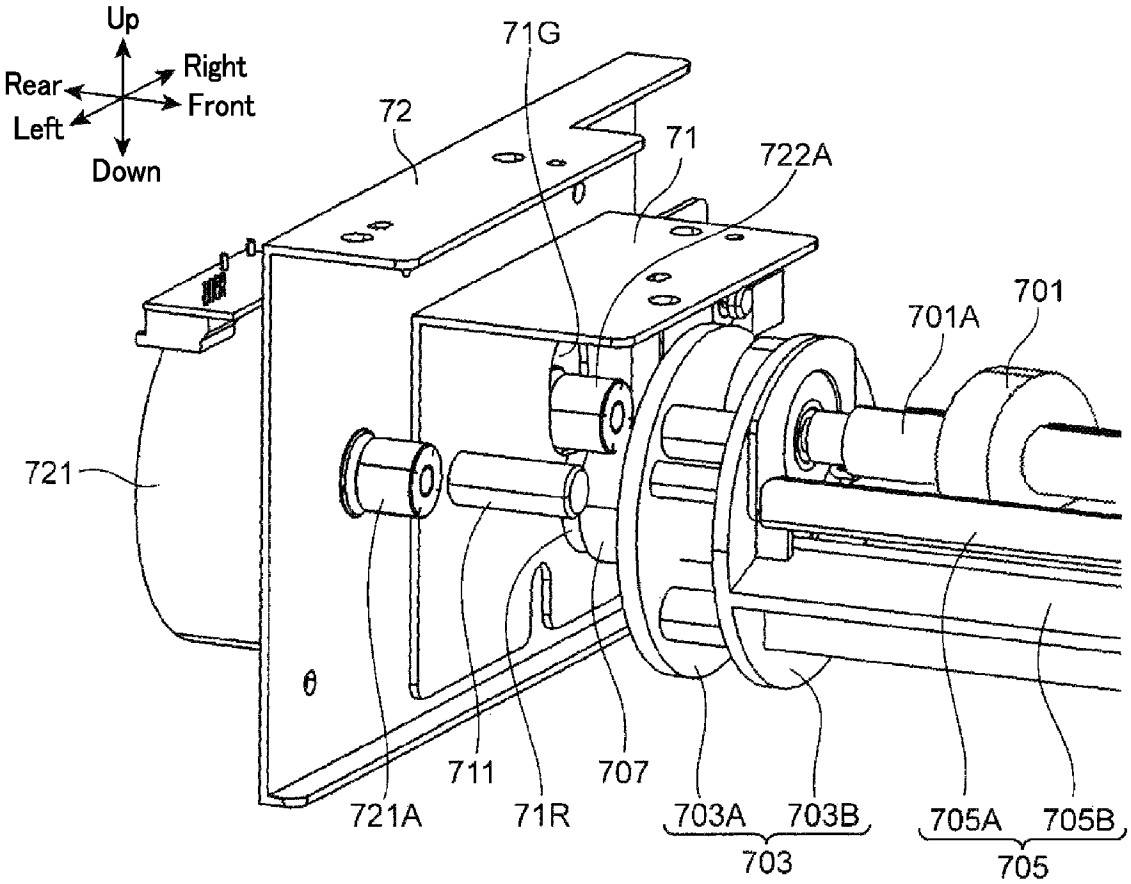
FIG. 9 is another enlarged perspective view of the decurler device according to the first embodiment of the present disclosure.

Next, a configuration of the decurler device 7 according to the first embodiment of the present disclosure will be specifically described with reference to FIGS. 3-9. As shown in FIG. 5, the decurler device 7 includes a correction unit 70, a first frame 71, and a second frame 72. The correction unit 70 is one example of a support unit, and the first frame 71 is one example of a frame. FIGS. 3 and 4 are perspective views of the correction unit 70 according to the first embodiment. FIG. 5 is a perspective view of the decurler device 7 according to the first embodiment. FIG. 6 is a perspective view showing a state in which the correction unit 70 is fitted to the first frame 71. FIG. 7 is a perspective view of the second frame 72. FIGS. 8 and 9 are enlarged perspective views of the decurler device 7. A curl of a sheet P conveyed in the horizontal conveyance path 50D in the image forming apparatus 1 is favorably corrected (decurled) by the decurler device 7.

The correction unit 70 is a main body of the decurler device 7. As shown in FIG. 5, the correction unit 70 is fitted to the first frame 71 and the second frame 72 at the rear of the conveyance unit 55. The rear of the conveyance unit 55 corresponds to the back of the paper of FIG. 1. Further, the correction unit 70 is also fitted to a frame (not shown) at the front of the conveyance unit 55. The front of the conveyance unit 55 corresponds to the front of the paper of FIG. 1.

As shown in FIG. 3, the correction unit 70 is extended in the back and forth directions. The correction unit 70 includes a unit shaft 700. The unit shaft 700 is one example of a third rotational shaft. The unit shaft 700 serves as a rotational shaft in rotation of the correction unit 70. Accordingly, the correction unit 70 rotates about the unit shaft 700 as the axial center. The unit shaft 700 is an axial part which extends in the back and forth directions at the center of the correction unit 70. The unit shaft 700 is arranged between an elastic roller shaft 701A and a rigid roller shaft 702A in parallel with the elastic roller shaft 701A. Further, the correction unit 70 includes an elastic roller 701, a rigid roller 702, a rear flange 703, a front flange 704, a first sheet guide 705, and a second sheet guide 706. The elastic roller 701 is one example of a first roller, and the rigid roller 702 is one example of a second roller.

The elastic roller 701 is elastically deformable. The elastic roller shaft 701A serves as a rotational shaft in rotation of the elastic roller 701. Accordingly, the elastic roller 701 rotates about the elastic roller shaft 701A as the axial center. The elastic roller shaft 701A is one example of a first rotational shaft. The elastic roller shaft 701A is rotatably supported by the rear flange 703 and the front flange 704. The elastic roller 701 is a roller member arranged around the elastic roller shaft 701A. A plurality of elastic rollers 701 are arranged in the axial direction (back and forth directions) of the elastic roller shaft 701A at intervals. In the first embodiment, the elastic roller 701 is formed of a rubber member.

As shown in FIG. 4, the rigid roller shaft 702A is in parallel with the elastic roller shaft 701A. The rigid roller shaft 702A is one example of a second rotational shaft. The rigid roller shaft 702A serves a rotational shaft in rotation of the rigid roller 702. Accordingly, the rigid roller 702 rotates about the rigid roller shaft 702A as the axial center. The rigid roller shaft 702A is rotatably supported by the rear flange 703 and the front flange 704. The rigid roller 702 is formed of a metal roller. In the first embodiment, the rigid roller 702 is made of a stainless material. The rigid roller 702 is pressed by the elastic roller 701 to elastically deform the elastic roller 701. This forms a nip portion N between the elastic roller 701 and the rigid roller 702. A sheet P passes through the nip portion N. See FIG. 11. The elastic roller 701 is elastically deformed, thereby forming the nip portion N curved along the peripheral surface of the rigid roller 702. The above described horizontal conveyance path 50D includes the nip portion N. A sheet P passes the nip portion N on the way of conveyance in a predetermined sheet conveyance direction (right to left) in the horizontal conveyance path 50D.

As shown in FIG. 3, the rear flange 703 is a side wall arranged orthogonal to the unit shaft 700 at the rear end part of the correction unit 70. The rear flange 703 is made up of two walls arranged in the back and forth directions at an interval. Specifically, the rear flange 703 includes a first rear flange portion 703A and a second rear flange portion 703B. The first rear flange portion 703A is a wall of the two walls of the rear flange 703. The wall is arranged outside of the other wall, i.e. the second rear flange portion 703B, in the axial direction of the unit shaft 700.

As shown in FIG. 4, a shape of a sector is cut out from the first rear flange portion 703A. The first rear flange portion 703A and the second rear flange portion 703B are connected in series by a plurality of connecting rods arranged at intervals in the circumferential direction. It is noted that the connecting rods are not shown.

Further, an outer circumferential gear 703G is formed on the outer circumferential part of the first rear flange portion 703A. The outer circumferential gear 703G has a plurality of gear teeth. As shown in FIG. 8, rotational drive force for driving the correction unit 70 is transmitted to the outer circumferential gear 703G from a first drive shaft 721A through a rotary gear 712.

As shown in FIG. 3, the front flange 704 is a side wall arranged orthogonal to the unit shaft 700 at the front end part of the correction unit 70. The front flange 704 is made up of two walls arranged at an interval in the back and forth directions. Specifically, the front flange 704 includes a first front flange portion 704A and a second front flange portion 704B. The first front flange portion 704A is a wall of the two walls of the front flange 704. The wall is arranged outside of the other wall, i.e. the second front flange portion 704B, in the axial direction of the unit shaft 700. The first front flange portion 704A and the second front flange portion 704B are connected in series by a plurality of connecting rods arranged at intervals in the circumferential direction. It is noted that the connecting rods are not shown.

The first sheet guide 705 is a pair of plate members which extend between the second rear flange portion 703B and the second front flange portion 704B. Specifically, the first sheet guide 705 includes a sheet guide portion 705A and a sheet guide portion 705B. A sheet P is conveyed between the sheet guide portion 705A and the sheet guide portion 705B. When the first sheet guide 705 faces upstream of the horizontal conveyance path 50D, the first sheet guide 705 guides to the nip portion N the sheet P which is conveyed to the first sheet guide 705 from the upstream side of the horizontal conveyance path 50D. By contrast, when the first sheet guide 705 faces downstream of the horizontal conveyance path 50D, the first sheet guide 705 guides a sheet P conveyed from the nip portion N downstream of the horizontal conveyance path 50D.

As shown in FIG. 4, the second sheet guide 706 is a pair of plate members which extend between the second rear flange portion 703B and the second front flange portion 704B. Specifically, the second sheet guide 706 includes a sheet guide portion 706A and a sheet guide portion 706B. A sheet P is conveyed between the sheet guide portion 706A and the sheet guide portion 706B. When the second sheet guide 706 faces upstream of the horizontal conveyance path 50D, the second sheet guide 706 guides to the nip portion N the sheet P which is conveyed to the second sheet guide 706 from the upstream side of the horizontal conveyance path 50D. By contrast, when the second sheet guide 706 faces downstream of the horizontal conveyance path 50D, the second sheet guide 706 guides a sheet P conveyed from the nip portion N downstream of the horizontal conveyance path 50D.

The correction unit 70 pivotally supports the elastic roller shaft 701A and the rigid roller shaft 702A, thereby rotatably supporting the elastic roller 701 and the rigid roller 702. Further, the correction unit 70 includes the unit shaft 700 in parallel with the elastic roller shaft 701A between the elastic roller shaft 701A and the rigid roller shaft 702A. The correction unit 70 is rotatable about the unit shaft 700.

As shown in FIG. 4, the correction unit 70 further includes an input gear 707, a relay gear 708, and a transmission gear 709.

The input gear 707 is arranged on the unit shaft 700 on the outside of the first rear flange portion 703A in the axial direction of the unit shaft 700. The input gear 707 is rotatable about the unit shaft 700. As shown in FIG. 9, the input gear 707 is joined to a second drive shaft 722A.

As shown in FIG. 4, the relay gear 708 is a gear arranged in the above described cut-out portion of the first rear flange 703. The relay gear 708 is rotatably supported by the second rear flange portion 703B. The relay gear 708 includes a first relay gear portion 708A and a second relay gear portion 708B. The first relay gear portion 708A and the second relay gear portion 708B are adjacently arranged in a direction in parallel with the axial direction of the unit shaft 700. The first relay gear portion 708A is engaged with the input gear 707. The second relay gear portion 708B is engaged with the transmission gear 709. The relay gear 708 receives rotational drive force from the input gear 707 and transmits the rotational drive force to the transmission gear 709.

The transmission gear 709 is fixed at the rigid roller shaft 702A between the first rear flange portion 703A and the second rear flange portion 703B. The transmission gear 709 rotates integrally with the rigid roller shaft 702A. When the rotational drive force is transmitted to the transmission gear 709 from the relay gear 708, the rigid roller 702 is rotated by the rotational drive force. Along with the rotation of the rigid roller 702, the elastic roller 701 rotates following the rotation of the rigid roller 702.

As shown in FIGS. 8 and 9, the first frame 71 rotatably supports the correction unit 70 at the back of the correction unit 70. The correction unit 70 is fitted to the first frame 71 in the direction indicated by the arrow D51 in FIG. 5.

As shown in FIGS. 8 and 9, the first frame 71 is a plate member having an L-shape in a cross sectional view and has a front surface and a back surface in the back and forth directions. An upper portion of the first frame 71 warps frontward. The first frame 71 includes a rotary shaft 711, the rotary gear 712, and a unit bearing 71R. Further, an opening 71G is formed in the first frame 71.

The rotary shaft 711 is a shaft projected forward from the left end part of the first frame 71 in the middle of the first frame 71 in the vertical direction. The rotary gear 712 is fitted to the rotary shaft 711.

The rotary gear 712 is rotatably supported by the rotary shaft 711. The rotary gear 712 includes a first gear portion 712A and a second gear portion 712B. The first gear portion 712A and the second gear portion 712B are adjacently arranged in the back and forth directions. The first gear portion 712A is engaged with the first drive shaft 721A. The second gear portion 712B is engaged with the outer circumferential gear 703G of the correction unit 70. The rotary gear 712 transmits rotational drive force generated by a rotary motor 721 to the correction unit 70.

As shown in FIG. 9, the unit bearing 71R is arranged at the lower right end part of the first frame 71. The unit shaft 700 of the correction unit 70 is inserted in the unit bearing 71R. Thus, the correction unit 70 is rotatably supported by the first frame 71.

The opening 71G is a long hole opened in the vertical direction above the unit bearing 71R. The opening 71G has a diameter in the vertical direction and a diameter in the transverse direction orthogonal to the vertical direction. The diameter in the vertical direction is larger than that in the transverse direction. The second drive shaft 722A is inserted into the opening 71G.

As shown in FIGS. 7-9, the second frame 72 supports the first frame 71. The first frame 71 is fixed at the second frame 72 by a screw (not shown). The second frame 72 is a plate member and has a front surface and a back surface in the back and forth directions. The size of the back surface and the front surface of the second frame 72 is larger than that of the first frame 71. The second frame 72 includes the rotary motor 721, a drive motor 722, a swinging piece 75, and a detection sensor 76.

The rotary motor 721 is arranged at the left end part on the back surface of the second frame 72. The rotary motor 721 is one example of a unit drive section. The drive force generated by the rotary motor 721 is rotational drive force for rotating the correction unit 70 about the unit shaft 700. The rotary motor 721 includes the first drive shaft 721A. The first drive shaft 721A penetrates the second frame 72 to protrude frontward of the second frame 72. As described above, the first drive shaft 721A is engaged with the first gear portion 712A of the rotary gear 712, thereby transmitting the rotational drive force of the rotary motor 721 to the rotary gear 712.

The drive motor 722 is arranged at a part slightly right from the center of the second frame 72 on the back surface of the second frame 72. The drive motor 722 is one example of a roller drive section. The drive force generated by the drive motor 722 is rotational drive force for rotating the rigid roller 702 in the correction unit 70 about the rigid roller shaft 702A. The drive motor 722 includes the second drive shaft 722A. The second drive shaft 722A penetrates the second frame 72 to protrude frontward of the second frame 72. The second drive shaft 722A penetrates the above described opening 71G of the first frame 71 to protrude frontward of the first frame 71. The second drive shaft 722A is engaged with the input gear 707 of the correction unit 70. Thus, the rotational drive force of the drive motor 722 is transmitted to the input gear 707. The rotational drive force of the drive motor 722 is transmitted to the transmission gear 709 from the input gear 707 through the relay gear 708. As a result, the rigid roller 702 is rotated by the rotational drive force of the drive motor 722. The input gear 707 is arranged coaxially with the unit shaft 700 of the correction unit 70. Thus, even when the correction unit 70 rotates, the rotational drive force is stably transmitted to the input gear 707 from the second drive shaft 722A.

As shown in FIG. 7, the swinging piece 75 is swingably arranged on the second frame 72 on the right side of the second drive shaft 722A. The swinging piece 75 is an L-shaped member in a front view. The swinging piece 75 includes a supporting portion 751 and a detection piece 752. The supporting portion 751 is arranged at the upper end part of the swinging piece 75 and is fixed at a shaft projected from the second frame 72. The supporting portion 751 serves as a swinging axis in swinging of the swinging piece 75. The detection piece 752 is arranged at the lower end part of the swinging piece 75 and extends rightward. The detection piece 752 is moved rightward in each rotation of the correction unit 70 to be detected by the detection sensor 76. Specifically, the detection piece 752 is detected in each rotation of the first drive shaft 721A.

The detection sensor 76 is arranged on the right side of the swinging piece 75. The detection sensor 76 is a sensor to detect the detection piece 752. The detection sensor 76 includes a light emitting section 761 and a light receiving section 762. Detection light is irradiated to the light receiving section 762 from the light emitting section 761. The detection light is interrupted by the detection piece 752. Thus, the detection sensor 76 detects the detection piece 752. When the first drive shaft 721A is rotated one round, the detection piece 752 is detected by the detection sensor 76 according to a predetermined rotational angle of the correction unit 70. A counter 820, which will be described later, counts step signals of the rotary motor 721 based on the timing of the detection of the detection piece 752. Then, a drive controller 810, which will be described later, controls the rotation of the rotary motor 721 based on the result of the step signals counted. As a result, the rotational angle of the correction unit 70 is adjusted.

Operation of Decurler Device

Figure 10:
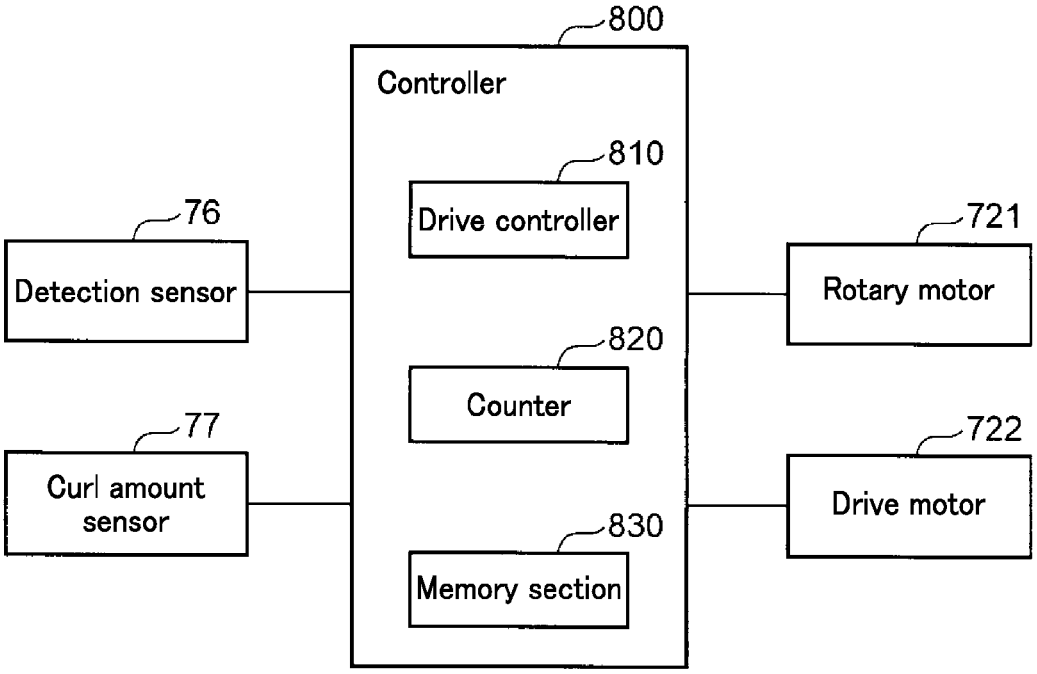
FIG. 10 is an electrical block diagram of a controller for controlling rotation of the correction unit according to the first embodiment of the present disclosure.

Next, a curl correction operation (decurling operation) of the decurler device 7 according to the first embodiment will be described with reference to FIGS. 2 and 10-12. FIG. 10 is an electrical block diagram of a controller 800. The controller 800 totally controls the decurler device 7. The controller 800 is electrically connected to a curl amount sensor 77 in addition to the detection sensor 76, the rotary motor 721, and the drive motor 722. The controller 800 sends a control signal to the rotary motor 721 and the drive motor 722. The curl amount sensor 77 is one example of a detection section.

As shown in FIG. 2, the curl amount sensor 77 is arranged downstream of the fusing section 60 in the sheet conveyance direction. The curl amount sensor 77 detects a characteristic value according to a curl amount of a sheet. In the first embodiment, the curl amount sensor 77 is a distance measuring sensor arranged in the body 10. The curl amount sensor 77 is arranged in the direction orthogonal to the surface of the sheet P to be conveyed. The curl amount sensor 77 is made up of a combination of a light emitting element and a light receiving element based on the triangulation method. It is noted that the light emitting element and the light receiving element are not shown. A semiconductor laser is used for the light emitting element. Light of the semiconductor laser is condensed through a transmitting lens (not shown) and is then irradiated to a sheet P. Thus, the diffuse reflection occurs on the sheet P. Part of the diffusion reflected light forms a spot on the light receiving element through a receiving lens (not shown). Thus, a distance from the curl amount sensor 77 to a target is detected. The curl amount sensor 77 measures a distance between each of the front end part, the center, and the rear end part of a sheet P in the sheet conveyance direction and the curl amount sensor 77. Fixing the position of the curl amount sensor 77 in advance can achieve detection of a curl amount of a sheet P based on a plurality of measured distances.

Although not shown, the controller 800 shown in FIG. 10 includes a central processing unit (CPU), a read only memory (ROM), a random access memory (RAM), etc. The ROM stores a control program. The RAM is used as a work area of the CPU. Execution of the control program by the CPU allows the controller 800 to operate as if the controller 800 functionally includes the drive controller 810, the counter 820 and a memory section 830.

The drive controller 810 controls the rotary motor 721 and the drive motor 722, thereby controlling the rotation of the correction unit 70 and the rotation of the rigid roller 702.

The counter 820 counts pulse step signals for rotation of the rotary motor 721, with reference to timing of detection of the detection piece 752 by the detection sensor 76. The drive controller 810 controls the rotation of the rotary motor 721 based on the count result of the counter 820. As a result, the rotational angle of the correction unit 70 is controlled.

The memory section 830 stores a table in advance for deriving a curl amount of a sheet P according to the characteristic value (distance) detected by the curl amount sensor 77. The drive controller 810 refers to the table stored in the memory section 830 based on the detection result by the curl amount sensor 77, thereby the drive controller 81 deriving a curl amount of a sheet P. It is determined based on the derived curl amount whether or not to rotate the correction unit 70. Thus, the correction unit 70 is favorably rotated according to the curl amount of the sheet P entering the nip portion N. Further, when it is determined that the correction unit 70 is to be rotated, the rotational angle of the correction unit 70 is determined based on the derived curl amount. Accordingly, the rotational angle of the correction unit 70 is adjusted according to the curl amount of the sheet P entering the nip portion N. Thus, the curl of the sheet P is further stably corrected.

Curl Correction (Decurling) of Sheet

Figure 11:
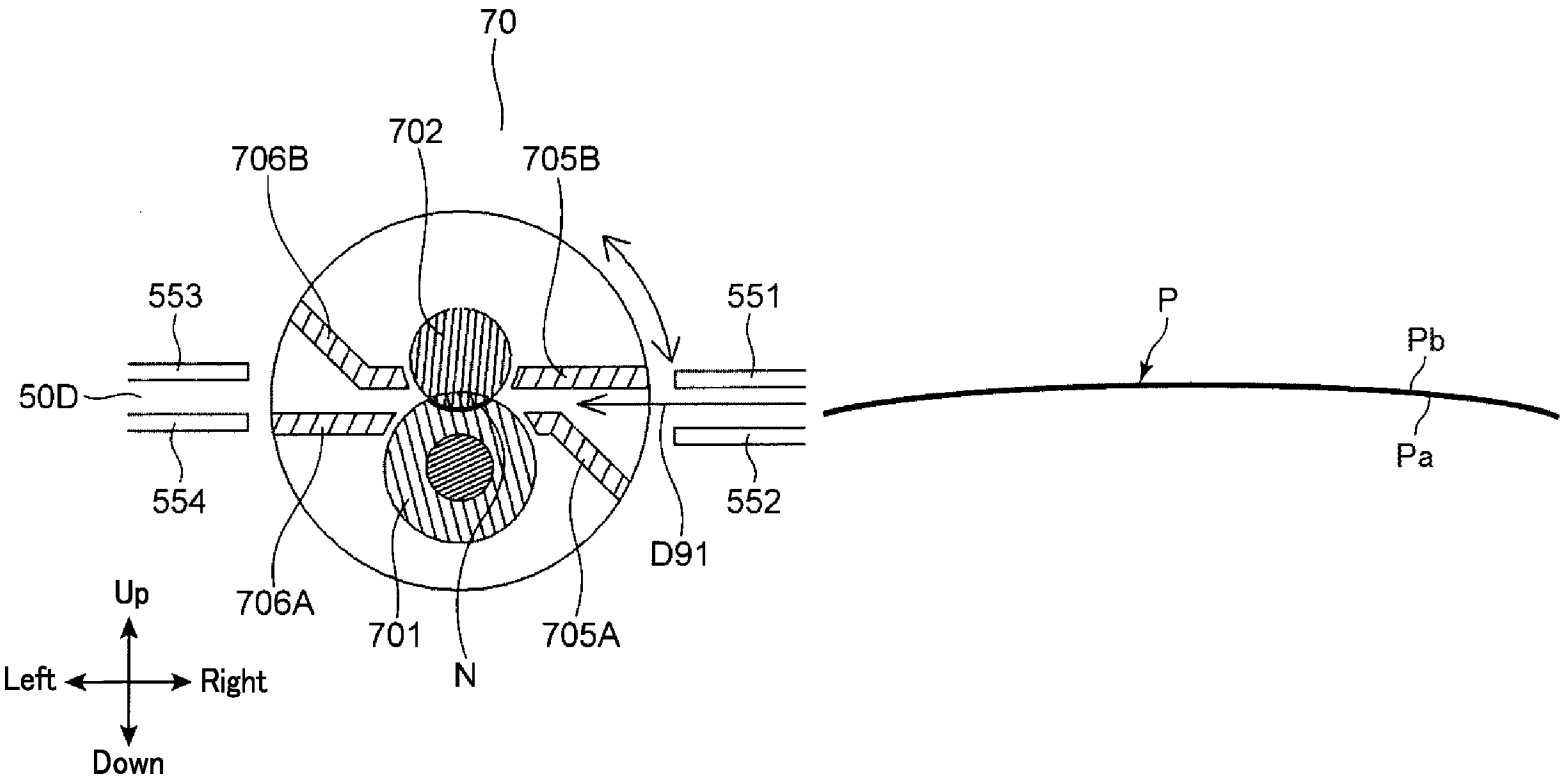
FIG. 11 is a cross sectional view showing a state in which a sheet enters the correction unit according to the first embodiment of the present disclosure.

Next, curl correction (decurling) of a sheet P will be described with reference to FIGS. 2, 11, and 12. After a toner image is formed on a sheet P in the image forming section 30, the toner image is fused to the sheet P in the fusing section 60. At that time, as shown in FIG. 11, the sheet P may tend to curl such that a first surface Pa of the sheet P is the inner periphery of a curl and a second surface Pb of the sheet P is the outer periphery of the curl. In other words, the lead edge of the sheet P tends to warp downward, i.e., the sheet P tends to result in a so-called downward curl. When the sheet P ejected from the fusing section 60 passes a point facing the curl amount sensor 77, the curl amount sensor 77 measures a distance between each of the front end part, the center, and the rear end part of the sheet P in the sheet conveyance direction and the curl amount sensor 77. The drive controller 810 derives the curl amount of the sheet P based on the measurement result of the curl amount sensor 77 and the table stored in the memory section 830 in advance. Further, the drive controller 810 determines whether the sheet P curls downward or upward according to the magnitude relationship of the plurality of distances detected by the curl amount sensor 77. The drive controller 810 determines that rotation of the correction unit 70 is necessary when the curl amount of the sheet P exceeds a predetermined value. Further, the drive controller 810 determines the rotational angle of the correction unit 70 according to the curl amount of the sheet P. In the first embodiment, the larger the curl amount of the sheet P becomes, the larger the rotational angle of the correction unit 70 is set.

As shown in FIG. 11, when a sheet P is conveyed in a downward curl state, the drive controller 810 pre-controls the rotational angle of the correction unit 70 so that the elastic roller 701 is in contact with the first surface Pa of the sheet P and the rigid roller 702 is in contact with the second surface Pb of the sheet P. This posture of the correction unit 70 is defined as a first posture.

The sheet P is conveyed into the correction unit 70 from between a first guide member 551 and a second guide member 552. The first guide member 551 and the second guide member 552 are arranged in the conveyance unit 55. The sheet P enters the nip portion N from between the sheet guide portion 705A and the sheet guide portion 705B. The elastic roller 701 arranged below is compressively deformed, thereby forming the nip portion N curved along the peripheral surface of the rigid roller 702 arranged above. Thus, the downward curl of the sheet P is favorably corrected (decurled) along the curved surface of the nip portion N.

Figure 12:
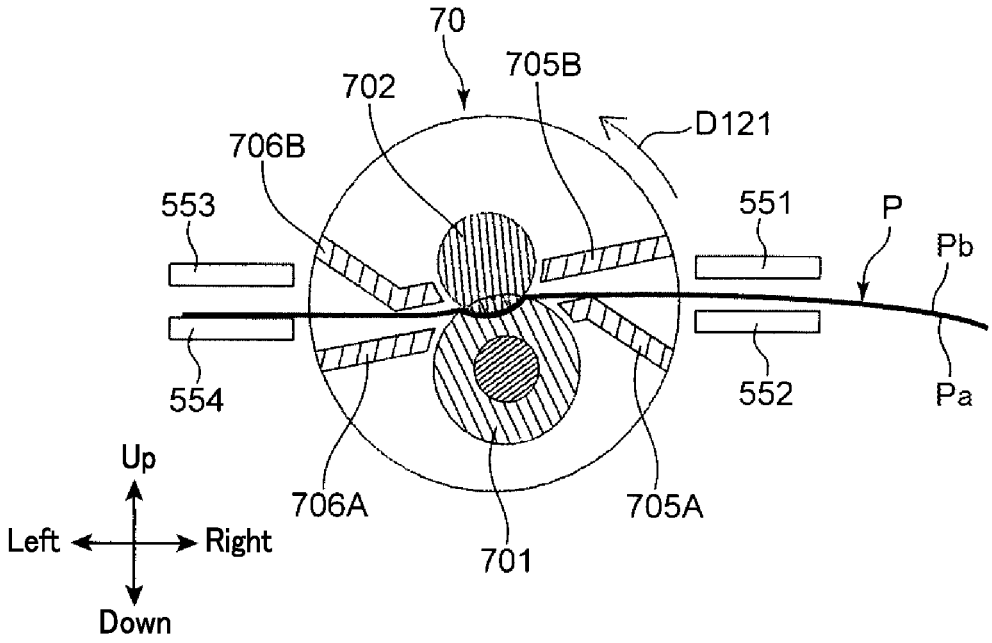
FIG. 12 is a cross sectional view showing a state in which the correction unit rotates with the sheet pinched by the correction unit according to the first embodiment of the present disclosure.

Further, in the first embodiment, when a sheet P is conveyed in the horizontal conveyance path 50D with it nipped by the nip portion N, the drive controller 810 rotates the correction unit 70 about the unit shaft 700 in the direction indicated by the arrow D121 in FIG. 12. Thus, the elastic roller 701 is moved upstream in the sheet conveyance direction, and the rigid roller 702 is moved downstream in the sheet conveyance direction. This rotation of the correction unit 70 applies the rotational force to the sheet P in the direction in which a curl of the sheet P is corrected (decurled). The rotational force further corrects the curl of the sheet P. Specifically, as shown in FIG. 12, when the sheet P is conveyed in a downward curl state, partial correction force is applied to the sheet P so that the first surface Pa of the sheet P is the outer periphery of a curl and the second surface Pb of the sheet P is the inner periphery of the curl along the curved-shape of the nip portion N. Thus, the curl of the sheet P is further corrected.

Next, a curl correction operation (decurling operation) will be described which is performed in the case where a sheet P curls such that the first surface Pa of the sheet P is the outer periphery of a curl and the second surface Pb of the sheet P is the inner periphery of the curl. When a sheet P is conveyed to the decurler device 7 in an upward curl state in which the lead edge of the sheet P warps upward, the drive controller 810 rotates the correction unit 70 by 180 degrees in advance from the state shown in FIG. 11. This posture of the correction unit 70 is defined as a second posture. At that time, the first surface Pa of the sheet P comes in contact with the rigid roller 702, and the second surface Pb of the sheet P comes in contact with the elastic roller 701. Then, the elastic roller 701 arranged above is compressively deformed to warp the nip portion N along the peripheral surface of the rigid roller 702, thereby favorably correcting (decurling) the upward curl of the sheet P which has entered the nip portion N. Further, the drive controller 810 rotates the correction unit 70 about the unit shaft 700 in the direction opposite to the direction indicated by the arrow D121 in FIG. 12, thereby further correcting (decurling) the curl of the sheet P.

As described above, the correction unit 70 is changeable in posture between the first posture and the second posture. Thus, a curl can be stably corrected (decurled) even when a sheet P curls upward or downward.

It is preferable that rotation of the correction unit 70 performed during the time when a sheet P is nipped by the nip portion N is performed after the lead edge of the sheet P reaches the pair of downstream rollers 55R shown in FIG. 2. When the correction unit 70 rotates before the lead edge of a sheet P reaches the pair of the downstream rollers 55R, the conveyance of the sheet P becomes slightly unstable in some cases. Accordingly, the drive controller 810 rotates the correction unit 70 about the unit shaft 700 with the lead edge of a sheet P sandwiched between the pair of the downstream rollers 55R, thereby achieving stable conveyance and stable curl correction (decurling) of the sheet P.

According to the first embodiment, a sheet P is conveyed in the horizontal conveyance path 50D in a predetermined conveyance direction while passing the nip portion N which is formed between the elastic roller 701 and the rigid roller 702. The elastic roller 701 and the rigid roller 702 are rotatably supported by the correction unit 70. The elastic roller 701 is pressed by the rigid roller 702 to be elastically deformed. Thus, the nip portion N is curved along the surface of the rigid roller 702. Thus, even when a sheet P entering the nip portion N curls, the curl of the sheet P is favorably corrected (decurled). Further, the drive controller 810 rotates the correction unit 70 about the unit shaft 700 during the time when a sheet P is nipped by the nip portion N. Thus, even in the case when a curl amount of a sheet P entering the nip portion N varies, the curl of the sheet P is stably corrected (decurled).

Further, according to the first embodiment, after the lead edge of a sheet P reaches the pair of downstream rollers 55R, the correction unit 70 rotates about the unit shaft 700. Accordingly, the correction unit 70 rotates in a state in which a sheet P lies between the nip portion N and the pair of the downstream rollers 55R. Thus, the interruption of the conveyance of the sheet P by the rotation of the correction unit 70 can be reduced.

Second Embodiment

Next, a decurler device 9 according to the second embodiment of the present disclosure will be described with reference to FIGS. 13-15. It is noted that a configuration of an image forming apparatus in the second embodiment is the same as that of the image forming apparatus 1 in the first embodiment described above. Accordingly, the description thereof will be omitted.

The decurler device 9 has a configuration in which a correction unit 90 and a pressure guide 80 are fitted to the above described first and second frames 71 and 72. The correction unit 90 corresponds to the correction unit 70 in the first embodiment. The pressure guide 80 is one example of a guide.

The correction unit 90 includes a unit shaft 900, an elastic roller 901, an elastic roller shaft 901A, a rigid roller 902, a rigid roller shaft 902A, a rear flange 903, a front flange 904, a first sheet guide 905, and a second sheet guide 906. They correspond to the unit shaft 700, the elastic roller 701, the elastic roller shaft 701A, the rigid roller 702, the rigid roller shaft 702A, the rear flange 703, the front flange 704, the first sheet guide 705, and the second sheet guide 706 which are included in the correction unit 70 described above.

Figure 13:
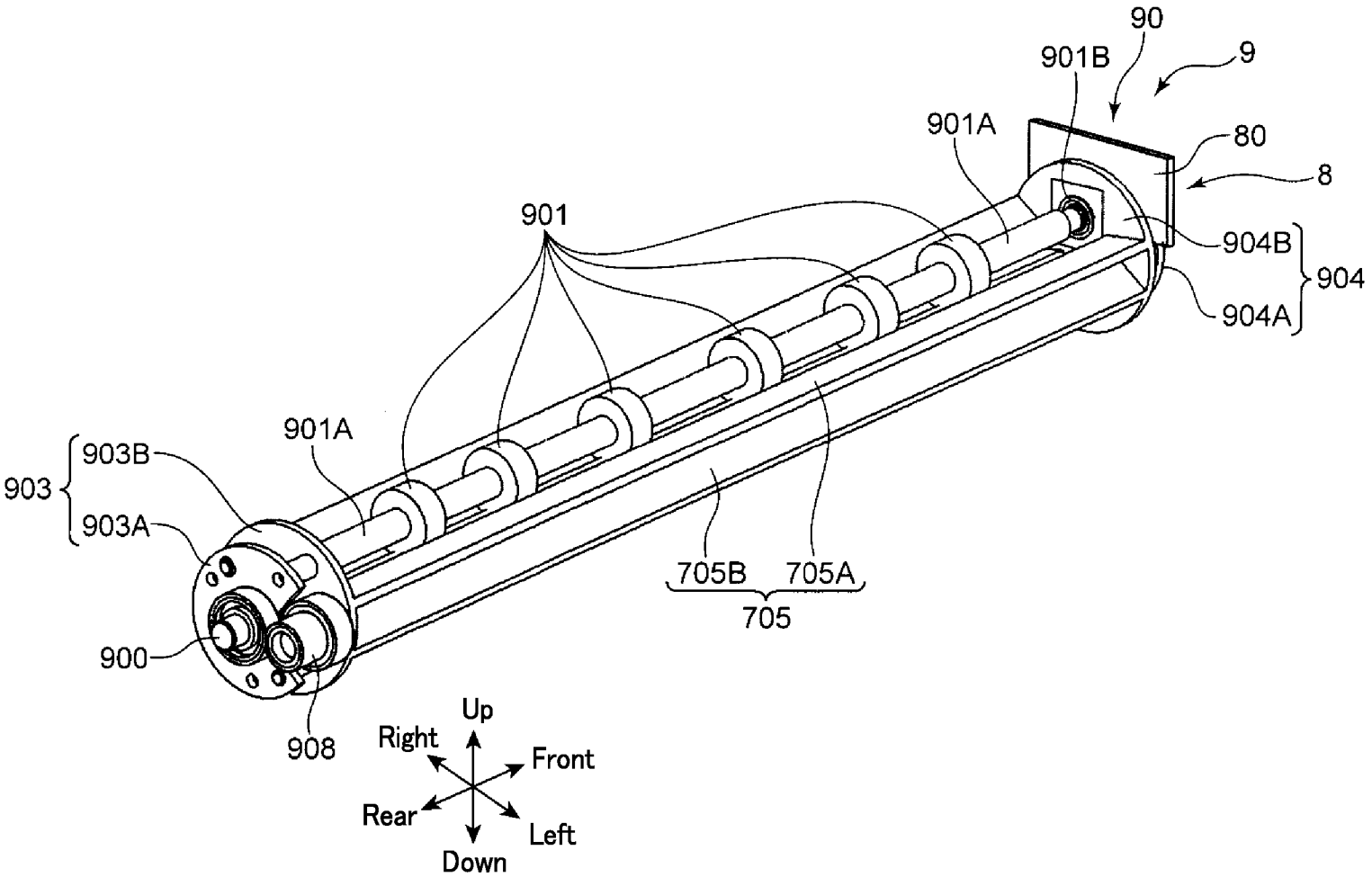
FIG. 13 is a perspective view of a correction unit according to the second embodiment of the present disclosure.

As shown in FIG. 13, the front flange 904 is made up of a first front flange portion 904A and a second front flange portion 904B. The first front flange portion 904A and the second front flange portion 904B respectively correspond to the above described first and second front flange portions 704A and 704B forming the front flange 704 of the correction unit 70. It is noted that the first front flange portion 704A and the second front flange portion 704B are connected in series by a plurality of connecting rods arranged in the circumferential direction in the correction unit 70. In contrast thereto, the first front flange portion 904A and the second front flange portion 904B are joined by an annular joint portion (not shown) arranged in the vicinity of the center in the radial direction in the correction unit 90.

The front flange 904 is arranged across the unit shaft 900 at the front end part of the unit shaft 900. Further, the elastic roller shaft 901A of the elastic roller 901 is inserted into a bearing 901B. The bearing 901B is a bearing member to rotatably support the elastic roller shaft 901A and forms an end part of the elastic roller shaft 901A. The elastic roller shaft 901A is movably supported in a long hole 907 opened in the second front flange portion 904B. The second front flange portion 904B is one example of a side wall.

The pressure guide 80 is arranged between the first front flange portion 904A and the second front flange portion 904B. The pressure guide 80 is a member forming part of the pressure changing section 8.

The pressure changing section 8 changes the pressure of the elastic roller 901 against the rigid roller 902 according to the rotational angle of the correction unit 90 about the unit shaft 900. The pressure changing section 8 includes the first frame 71 and the pressure guide 80. The pressure at the nip portion N is changed by the pressure changing section 8 according to the rotational angle of the correction unit 90. Thus, curl correction force can be changed according to the rotation of the correction unit 90.

The long hole 907 is a hole formed in the second front flange portion 904B. As shown in FIG. 14, the long hole 907 has a first diameter and a second diameter shorter than the first diameter. That is, the first diameter is a long diameter, and the second diameter is a short diameter. In the posture of the long hole 907 shown in FIG. 14, the diameter in the vertical direction corresponds to the first diameter, and the diameter in the transverse direction corresponds to the second diameter. The elastic roller shaft 901A and the rigid roller shaft 902A are arranged side by side in a direction of the first diameter of the long hole 907. In other words, the long hole 907 extends in the direction in which the elastic roller shaft 901A and the rigid roller shaft 902A are arranged side by side. The elastic roller shaft 901A is supported movably in the direction of the first diameter in the long hole 907.

The pressure guide 80 is fixed at a forward extending part of the first frame 71. The pressure guide 80 is arranged in the first frame 71 to face the front flange 904. The bearing 901B of the elastic roller 901 comes into contact with the pressure guide 80. The pressure guide 80 moves the elastic roller shaft 901A along the long hole 907 in direction of the first diameter along with the rotation of the correction unit 90 about the unit shaft 900.

The pressure guide 80 is a plate member with a substantially rectangular shape in a front view. A cut-out portion 80A is arranged at the lower end part in the central part of the pressure guide 80. The cut-out portion 80A has a shape cut out upward at the lower end part of the pressure guide 80. The cut-out portion 80A includes a moving guide segment 803, a first guide segment 801, and a second guide segment 802. The moving guide segment 803 forms the right end part of the cut-out portion 80A. The moving guide segment 803 is a substantially circular wall of the pressure guide 80. The first guide segment 801 continues to the moving guide segment 803 and forms the upper end part of the cut-out portion 80A. The first guide segment 801 is a wall of the pressure guide 80 which is slightly curved and extends in the substantially transverse direction. The second guide segment 802 continues to the first guide segment 801. The second guide segment 802 forms the left end part of the cut-out portion 80A. The second guide segment 802 is a wall of the pressure guide 80 which is slightly curved and extends in the substantially perpendicular direction.

Figure 14:
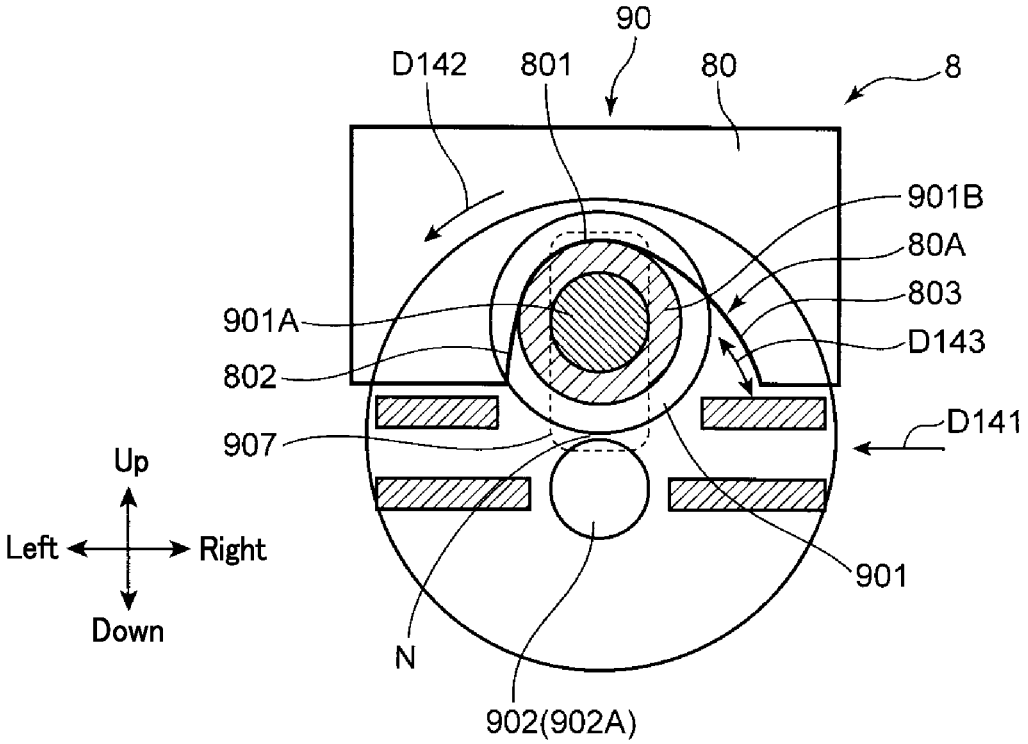
FIG. 14 is a cross sectional view showing a state in which a sheet enters the correction unit according to the second embodiment of the present disclosure.

The state shown in FIG. 14 is defined as a first state. In the first state, the rotational angle of the correction unit 90 is controlled so that the direction in which the elastic roller shaft 901A and the rigid roller shaft 902A are arranged is substantially orthogonal to the sheet conveyance direction in a cross sectional view across the elastic roller shaft 901A. In other words, the direction of the first diameter of the long hole 907 is substantially orthogonal to the sheet conveyance direction indicated by the arrow D141 in FIG. 14. Further, in this first state, a sheet P moves toward and enters the nip portion N in the direction indicated by the arrow D141.

In the first state, the bearing 901B supporting the elastic roller 901 comes into contact with the first guide segment 801 of the cut-out portion 80A of the pressure guide 80. At that time, the first guide segment 801 of the pressure guide 80 urges the elastic roller shaft 901A toward the rigid roller 902. Then, the nip portion N is formed between the elastic roller 901 and the rigid roller 902. It is noted that although the elastic roller 901 is slightly separated from the rigid roller 902 in FIG. 14 for sake of the explanation, the elastic roller 901 is pressed against the rigid roller 902 by a first pressure force P1 in practice.

Figure 15:
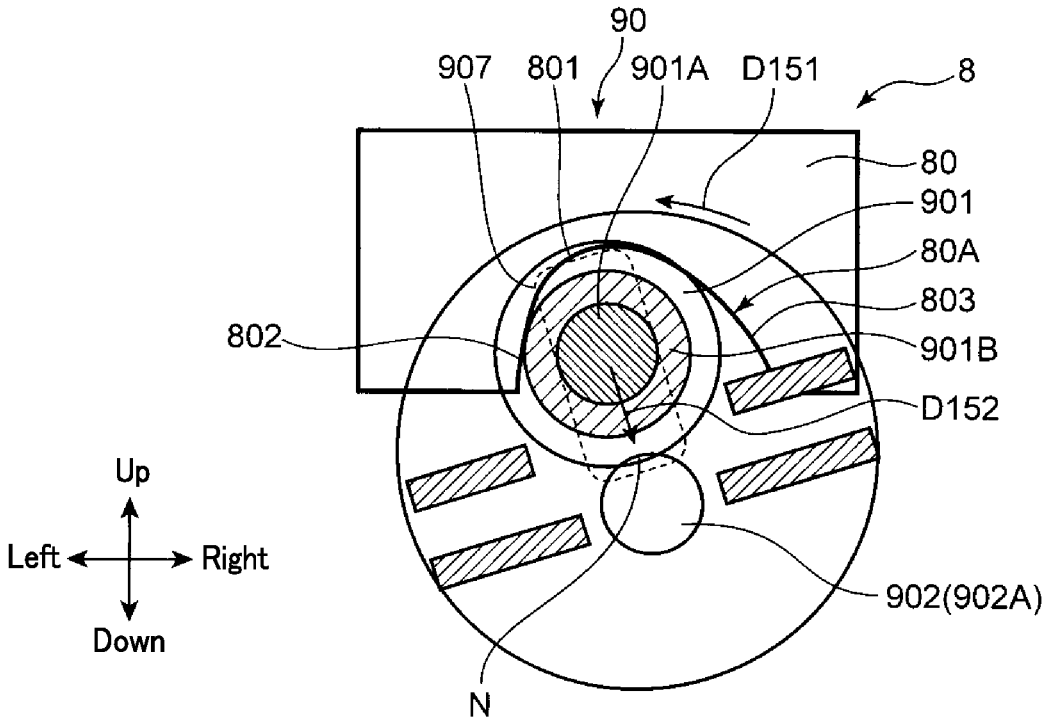
FIG. 15 is a cross sectional view showing a state in which the correction unit rotates with the sheet pinched by the correction unit according to the second embodiment of the present disclosure.

When a sheet P enters the nip portion N, the correction unit 90 rotates about the unit shaft 900 in the direction indicated by the arrow D151 in FIG. 15 as in the case of the first embodiment. The state shown in FIG. 15 is defined as a second state. In the second state, the bearing 901B supporting the elastic roller 901 comes into contact with the second guide segment 802. Thus, along with the rotation of the correction unit 90, the bearing 901B moves along the long hole 907 in the direction indicated by the arrow D152 in FIG. 15. In other words, the elastic roller 901 moves toward the rigid roller 902. Accordingly, the second guide segment 802 of the pressure guide 80 urges the elastic roller 901 toward the rigid roller 902 at a point closer to the rigid roller 902 than the first guide segment 801. Thus, the elastic roller 901 is pressed against the rigid roller 902 by a second pressure force P2 larger than the first pressure force P1. As a result, the pressure force of the elastic roller 901 against the rigid roller 902 increases along with the rotation of the correction unit 90 about the unit shaft 900. This can correct a curl of a sheet P passing the nip portion N with larger force.

As described above, according to the second embodiment, the pressure guide 80 moves the elastic roller shaft 901A along the long hole 907 along with the rotation of the correction unit 90 to move the elastic roller 901 close to the rigid roller 902. Accordingly, the pressure force of the elastic roller 901 against the rigid roller 902 changes.

Further, according to the second embodiment, in the first state in which the rotational angle of the correction unit 90 is controlled so that the direction of the first diameter of the long hole 907 is substantially orthogonal to the sheet conveyance direction and a sheet P enters the nip portion N, the first guide segment 801 urges the elastic roller shaft 901A toward the rigid roller 902. Further, in the second state, the second guide segment 802 urges the elastic roller shaft 901A toward the rigid roller 902 at a point closer to the rigid roller 902 than the first guide segment 801. Accordingly, the first guide segment 801 and the second guide segment 802 can favorably change the pressure force of the elastic roller 901 against the rigid roller 902 according to the rotation of the correction unit 90.

It is noted that when the correction unit 90 rotates from the first state shown in FIG. 14 so that the elastic roller 901 moves upstream in the sheet conveyance direction and the rigid roller 902 moves downstream in the sheet conveyance direction, the bearing 901B supporting the elastic roller 901 is moved along the moving guide segment 803 of the cut-out portion 80A in the direction indicated by the arrow 143 in FIG. 14.

Other Embodiments

The decurler devices 7 and 9 and the image forming apparatus 1 according to the embodiments of the present disclosure have been described above. However, the present disclosure is not limited to the above embodiments. For example, following embodiments may be employed.

(1) In the first embodiment described above, during the time when a sheet P is nipped by the nip portion N, the drive controller 810 rotates the correction unit 70 about the unit shaft 700 in the direction indicated by the arrow D121 in FIG. 12. At that time, the elastic roller 701 is moved upstream in the sheet conveyance direction, and the rigid roller 702 is moved downstream in the sheet conveyance direction. However, the present disclosure is not limited to this. Alternatively, the elastic roller 701 may be moved downstream in the sheet conveyance direction, and the rigid roller 702 may be moved upstream in the sheet conveyance direction. Even in this case, the rotational force for curl correction can be applied to a sheet P, thereby favorably correcting (decurling) the curl of the sheet P.

(2) In the first and second embodiments described above, the curl amount sensor 77, which is a distance measuring sensor, has been given as an example of a sensor to detect a characteristic value corresponding to a curl amount of a sheet P. However, the curl amount sensor 77 is not limited to a distance measuring sensor. A characteristic value other than the distance may be sensed as a characteristic value corresponding to a curl amount. For example, a light reflection type sensor may be employed to detect a curl amount of a sheet P based on the reflection angle of light irradiated toward the front end part of the sheet P.

(3) In the second embodiment described above, the decurler device 9 includes one pressure guide 80. However, the present disclosure is not limited to the device including the one pressure guide. Another pressure guide having the same shape as the pressure guide 80 may be arranged in point-symmetry with the pressure guide 80 with respect to the unit shaft 900. In this case, the pressure force of the elastic roller 901 against the rigid roller 902 can vary between the first and second postures of the correction unit 90.

What is claimed is:

1. A decurler device, comprising:

a first roller with elastic deformability including a first rotational shaft and configured to rotate about the first rotational shaft as an axial center;

a second roller including a second rotational shaft in parallel with the first rotational shaft and configured to rotate about the second rotational shaft as an axial center, to elastically deform the first roller by being pressed by the first roller to form a curved nip portion between the second roller and the first roller, and to convey a sheet;

a support unit configured to pivotally support the first and second rotational shafts to rotatably support the first and second rollers and including a third rotational shaft in parallel with the first rotational shaft, the support unit being rotatable about the third rotational shaft as a center axis;

a unit drive section configured to rotate the support unit; a roller drive section configured to rotate the second roller; and a drive controller configured to control the unit drive section and the roller drive section to rotate the support unit when the sheet is conveyed by the curved nip portion.

2. A decurler device according to claim 1, further comprising:

a detection section arranged upstream of the nip portion in a sheet conveyance direction in which a sheet is conveyed and configured to detect a characteristic value according to a curl amount of a sheet, wherein the drive controller determines whether or not to rotate the support unit according to the characteristic value detected by the detection section.

3. A decurler device according to claim 2, wherein the drive controller determines a rotational angle of the support unit according to the characteristic value detected by the detection section.

4. A decurler device according to claim 1, further comprising:

a pressure changing section configured to change a pressure of the first roller against the second roller by rotation of the support unit.

5. A decurler device according to claim 4, wherein the support unit includes a flange portion, in which a long hole with a long axis is formed, the flange portion rotatably supporting the first rotational shaft and the second rotational shaft and supporting the first rotational shaft movably in the long hole in a direction of the long axis, and the pressure changing section includes a guide configured to come into contact with an end part of the first rotational shaft by rotation of the third shaft to move the first rotational shaft in the direction of the long axis.

6. A decurler device according to claim 5, wherein the guide includes:

a first guide segment configured to come into contact with the end part of the first rotational shaft to press the first rotational shaft toward the second roller in a first state in which the direction of the long axis is orthogonal to a sheet conveyance direction and a second guide segment continuing to the first guide segment and configured to come into contact with the end part of the first rotational shaft to press the first rotational shaft toward the second roller.

7. A decurler device according to claim 5, wherein the flange portion and the guide are arranged at opposite ends of the support unit.

8. A decurler device according to claim 1, wherein the drive controller controls the unit drive section to rotate the support unit to change a posture of the support unit between a first posture in which a rotational angle of the support unit is determined so that a first surface of a sheet is in contact with the first roller and a second surface of the sheet which is opposite to the first surface is in contact with the second roller and a second posture in which the rotational angle of the support unit is determined so that the second surface of a sheet is in contact with the first roller and the first surface of the sheet is in contact with the second roller.

9. A decurler device according to claim 8, wherein the drive controller sets the support unit in the first posture when a curl of a sheet conveyed toward the nip portion is in a state in which the first surface of the sheet is an inner periphery of the curl and the second surface of the sheet is an outer periphery of the curl.

10. A decurler device according to claim 9, wherein the drive controller rotates the support unit so that the first roller moves further upstream in a sheet conveyance direction than a position of the first roller in the first posture and the second roller moves further downstream in the sheet conveyance direction than a position of the second roller in the first posture after a sheet enters the nip portion in the first posture.

11. An image forming apparatus, comprising:

a decurler device including:

a first roller with elastic deformability including a first rotational shaft and configured to rotate about the first rotational shaft as an axial center;

a second roller including a second rotational shaft in parallel with the first rotational shaft and configured to rotate about the second rotational shaft as an axial center, to elastically deform the first roller by being pressed by the first roller to form a curved nip portion between the second roller and the first roller, and to convey a sheet;

a support unit configured to pivotally support the first and second rotational shafts to rotatably support the first and second rollers and including a third rotational shaft in parallel with the first rotational shaft, the support unit being rotatable about the third rotational shaft as a center axis;

a unit drive section configured to rotate the support unit;

a roller drive section configured to rotate the second roller; and a drive controller configured to control the unit drive section and the roller drive section to rotate the support unit when the sheet is conveyed by the curved nip portion;

a sheet conveyance path which includes the nip portion in the decurler device and in which a sheet is conveyed in a sheet conveyance direction; and an image forming section arranged in a vicinity of the sheet conveyance path and configured to form an image on a sheet.

12. An image forming apparatus according to claim 11, further comprising:

a fusing section configured to fuse a toner image to a sheet, wherein the image forming section transfers a toner image to a sheet, and the decurler device is arranged downstream of the fusing section in the sheet conveyance direction.

13. An image forming apparatus according to claim 11, wherein the drive controller of the decurler device rotates the support unit of the decurler device after a lead edge of a sheet passes the nip portion and reaches a downstream side of the sheet conveyance path joined to the support unit.

* * * * *